US007559354B2

(12) United States Patent
Graves et al.

(10) Patent No.: US 7,559,354 B2
(45) Date of Patent: Jul. 14, 2009

(54) APPARATUS AND METHOD FOR SIMULTANEOUS USAGE OF MULTIPLE DIE CASTING TOOLS

(75) Inventors: Dave L Graves, Washington, MO (US); Gerard M Hellebusch, Washington, MO (US); Patrick Robert Meyer, Marthasville, MO (US); John A Yegge, Sr., Warrenton, MO (US); Todd Rio, Union, MO (US)

(73) Assignee: Efficient Manufacturing Systems, LLC, Wright City, MO (US)

( * ) Notice: Subject to any disclaimer, the term of this patent is extended or adjusted under 35 U.S.C. 154(b) by 148 days.

(21) Appl. No.: 11/734,654

(22) Filed: Apr. 12, 2007

(65) Prior Publication Data

US 2007/0187063 A1 Aug. 16, 2007

Related U.S. Application Data

(62) Division of application No. 11/248,983, filed on Oct. 12, 2005, now Pat. No. 7,216,692.

(60) Provisional application No. 60/618,056, filed on Oct. 12, 2004.

(51) Int. Cl.
*B22D 17/26* (2006.01)

(52) U.S. Cl. ..... 164/341; 164/312

(58) Field of Classification Search ..... 164/312, 164/341

See application file for complete search history.

(56) References Cited

U.S. PATENT DOCUMENTS 3,866,666 A 2/1975 Wunder
3,954,378 A 5/1976 Johansson
4,754,801 A 7/1988 Ueno et al.
4,905,749 A 3/1990 Mihara
5,298,206 A 3/1994 Milliken et al.
5,660,223 A 8/1997 Thieman et al.
5,701,945 A 12/1997 McKibben et al.
6,467,528 B1 10/2002 Kamm et al.

(Continued)

FOREIGN PATENT DOCUMENTS

CA 2150941 6/1994

(Continued)

*Primary Examiner*—Kuang Lin
(74) *Attorney, Agent, or Firm*—Polster, Lieder, Woodruff & Lucchesi, L.C.

(57) ABSTRACT

The preferred embodiment of the present invention is a die casting apparatus and method evidencing increased apparatus output including the ability of using multiple die tools. The invention includes an indexing assembly removably engaged with at least one die block assembly for transporting between four stations, including an injection station, a cooling station, an ejection station, and a recovery station. The injection station includes a frame, a clamp assembly attached to the frame for clamping and releasing the die block assembly, a shot sleeve assembly engaged with the die block assembly for receiving molten material, such as metal, from a furnace means and injecting the molten material into the die block assembly, and a shot cylinder releasably coupled with the shot sleeve assembly for controlling the injection of molten material. The ejection station includes an ejector lift assembly which engages the die block assembly for ejecting a finished part from the die block assembly, and the recovery station includes an ejector drop assembly which engages the die block assembly for placing a preload on the die block assembly.

21 Claims, 26 Drawing Sheets

U.S. PATENT DOCUMENTS

| | | | | |
|---|---|---|---|---|
| 6,722,875 | B2 * | 4/2004 | Ralph et al. | 425/576 |
| 7,216,692 | B1 | 5/2007 | Graves et al. | |
| 2004/0118549 | A1 | 6/2004 | Zanoletti | |

FOREIGN PATENT DOCUMENTS

| | | |
|---|---|---|
| JP | 63030167 | 2/1988 |
| JP | 63040660 | 2/1988 |
| JP | 63049355 | 3/1988 |
| JP | 01057972 | 3/1989 |
| JP | 02015861 | 1/1990 |
| JP | 02015864 | 1/1990 |
| WO | 9511792 | 4/1995 |

* cited by examiner

| | Time (s) | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| | 0 | 0.5 | 1 | 1.5 | 2 | 2.5 | 3 | 3.5 | 4 | 4.5 | 5 | 5.5 | 6 | 6.5 | 7 | 7.5 | 8 | 8.5 | 9 | 9.5 | 10 | 10.5 | 11 | 11.5 | 12 | 12.5 | 13 | 13.5 | 14 | 14.5 | 15 |
| Station 1 | Table raises | | | Table indexes | | | | Table lowers | | Clamp Extends | | Shot sleeve couples to shot cylinder | | Shot cylinder retracts | | Pump fills shot sleeve | | | | Shot rod moves forward | | Shot injected | | Intensification occurs | | | | Shot cylinder uncouples from shot rod | | Shot cylinder retracts | |
| | | | | | | | | | | Conduit engages shot sleeve | | | | | | | | | | | | | | | | | | Shot rod couples with coupler | | Clamp retracts | |
| | | | | | | | | | | Shot cylinder extends | | | | | | | | | | | | | | | | | | | | | |
| Station 2 | Table raises | | | Table indexes | | | | Table lowers | | Cooling occurs | | | | | | | | | | | | | | | | | | Unlock lock assemblies | | Cylinders retract | |
| Station 3 | Table raises | | | Table indexes | | | | Table lowers | | Lift cylinders extend | | | | Robotic arm moves in | | Robotic arm grabs part | | Part is ejected | | Robotic arm removes part | | Die returns to open position | | Lock lock assemblies | | Lift cylinders retract | | | | Nothing | |
| | | | | | | | | Die splits | | | | | | | | | | | | | | | | | | Cylinders retract | | | | | |
| Station 4 | Table raises | | | Table indexes | | | | Table lowers | | Spray head moves in | | Spraying occurs | | | | Blow off occurs | | | | | | Unlock lock assemblies | | Lift cylinders retract | | | | Lock lock assemblies | | | |
| | | | | | | | | | | | | | | | | | | Lift cylinders extend | | | | | | | | Cylinders retract | | | | Cylinders retract | |
| | 0 | 0.5 | 1 | 1.5 | 2 | 2.5 | 3 | 3.5 | 4 | 4.5 | 5 | 5.5 | 6 | 6.5 | 7 | 7.5 | 8 | 8.5 | 9 | 9.5 | 10 | 10.5 | 11 | 11.5 | 12 | 12.5 | 13 | 13.5 | 14 | 14.5 | 15 |

FIGURE 15

APPARATUS AND METHOD FOR SIMULTANEOUS USAGE OF MULTIPLE DIE CASTING TOOLS

CROSS-REFERENCE TO RELATED APPLICATIONS

This application is related to U.S. patent application Ser. No. 11/248,983 filed Oct. 12, 2005, from which priority is claimed, which is related to U.S. Provisional Patent Application No. 60/618,056 filed Oct. 12, 2004, and are hereby incorporated by reference.

STATEMENT REGARDING FEDERALLY SPONSORED RESEARCH

Not Applicable.

BACKGROUND OF THE INVENTION

The present invention relates to a die casting apparatus and method of use. More specifically, the present invention relates to die casting apparatus and method evidencing increased apparatus output including the ability of using multiple die tools. While the invention is described in particular with respect to die casting, those skilled in the art will recognize the wider applicability of the inventive concepts set forth hereinafter Die-casting is a popular manufacturing process because of its ability to cost-effectively produce complex parts while maintaining tight tolerances. Generally, the die-casting process begins by melting an appropriate material, such as zinc, aluminum, and magnesium alloys. Then, the molten material is injected into a die, using either a hot chamber or cold chamber method. The molten material is held under pressure within the die until it solidifies into a finished part. Next, the die opens and the part is ejected from the die. Subsequently, the die is cleaned and prepared for another cycle. Typically, this process can be cyclically repeated producing a new part about every 60 seconds.

Current designs of die-casting apparatus require a large amount of initial setup time before the production process begins, referred to as a production run. These designs are a result of efforts to automate and increase the speed of production runs. In spite of this, cycle times faster than the current standard of about 60 seconds are needed to better compete against other manufacturing methods. In addition, production runs using current designs are limited to using only one type of die at a time with each die producing the same part. Therefore, only large production runs of identical parts can be produced cost-effectively. In other words, it is not possible to cost-effectively produce either small production runs of parts or production runs of multiple parts.

Therefore, what is needed is a die-casting apparatus and method with faster cycle times that can cost-effectively produce both large and small runs of parts. Also, there is a need for a die-casting apparatus that can produce multiple parts during a single run.

SUMMARY OF THE INVENTION

Briefly stated, the preferred form of the present invention is a die casting apparatus comprising an indexing assembly removably engaged with at least one die block assembly for transporting between stations and an injection station including a frame, a clamp assembly attached to the frame for clamping and releasing at least one die block assembly, a shot sleeve assembly engaged with the die block assembly for receiving molten material from a furnace means and injecting the molten material into the die block assembly, a shot cylinder releasably coupled with the shot sleeve assembly for controlling the injection of molten material. The invention also comprises a cooling station for solidifying the molten material within the die cast assembly into a solid part, an ejection station including an ejector lift assembly which engages at least one die block assembly for ejecting a finished part from the die block assembly, and a recovery station including an ejector drop assembly which engages at least one die block assembly for placing a preload on the die block assembly.

The foregoing and other features, and advantages of the invention as well as other embodiments thereof will become more apparent from the reading of the following description in connection with the accompanying drawings.

DESCRIPTION OF THE DRAWINGS

In the accompanying drawings which form part of the specification:

FIG. 15 is a timetable detailing the timing of events at Stations 1-4.

Corresponding reference numerals indicate corresponding parts throughout the several figures of the drawings.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
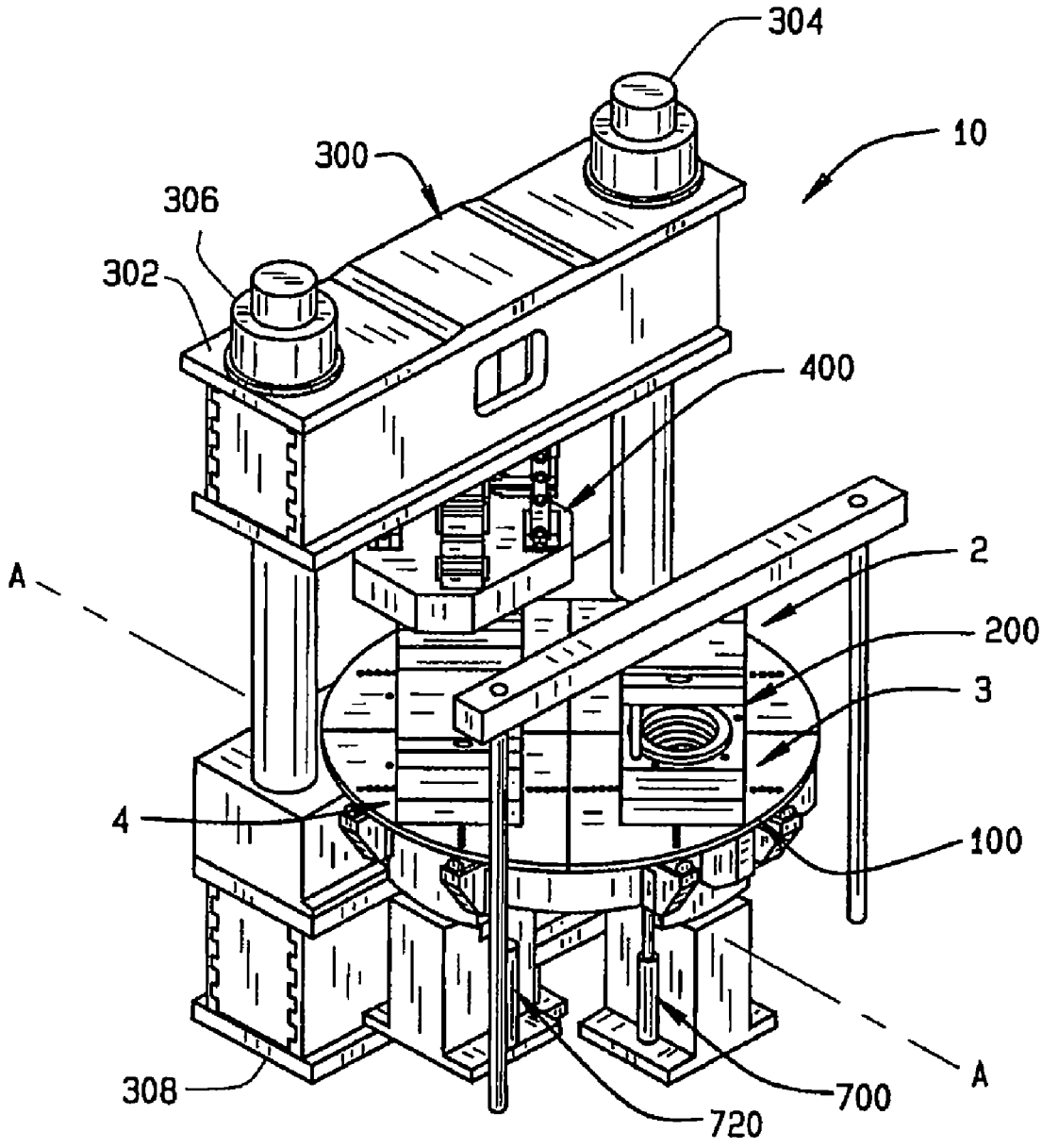
FIG. 1 is a perspective view of one illustrative embodiment of die casting apparatus of the present invention.

FIG. 1 illustrates a perspective view of an embodiment of a die-casting apparatus 10 of the present invention. The die-casting apparatus 10 divides the die-casting process into four stations: injection station 1, cooling station 2, ejection station 3, and recovery station 4. In general, at station 1 molten material is injected into a die block assembly 200. At station 2, the molten material cools and solidifies into a finished part. At station 3, the finished part is ejected from the die block assembly 200. Finally, at station 4 the die block assembly 200 is cleaned, lubricated, and cooled in preparation for another cycle through all four stations.

Figure 4:
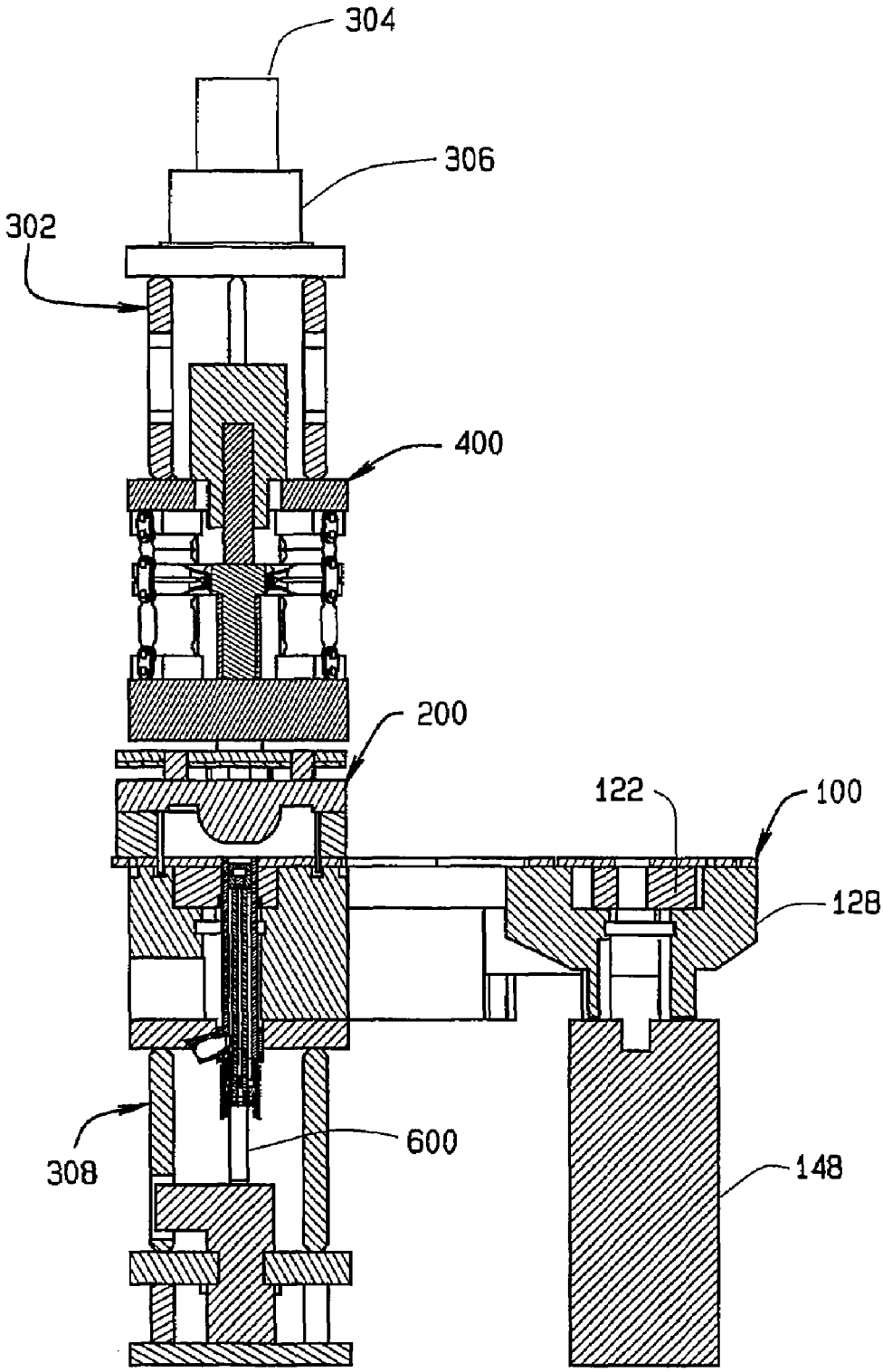
FIG. 4 is a section view along line A-A in FIG. 1.

Illustrated in FIGS. 1 and 4, the die-casting apparatus 10 includes a number of assemblies: an indexing assembly 100, a die block assembly 200, a frame assembly 300, a clamp assembly 400, a shot sleeve assembly 500, an ejector lift assembly 700, and an ejector drop assembly 720. For ease of understanding the present invention, the following description will explain these assemblies as they relate to each station. This will be followed by a description of the overall operation and method of use of the apparatus 10.

Figure 2:
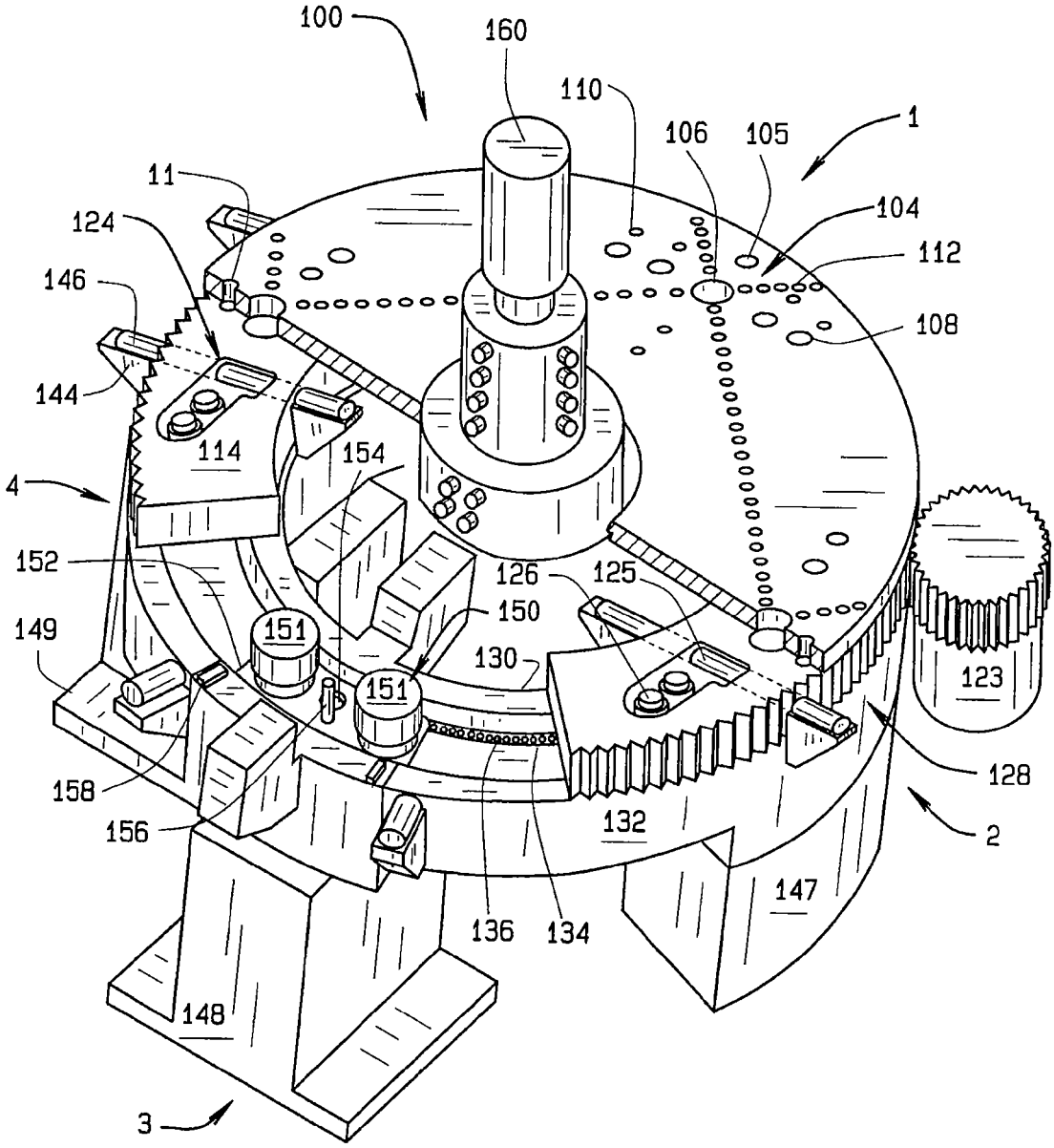
FIG. 2 is a partial perspective view of an indexing table assembly employed with the embodiment of FIG. 1.

Illustrated in FIG. 2, the indexing assembly 100 is an integral part of all four stations, because it transports the die block assembly 200 between stations. The indexing assembly 100 includes an indexing table 102, a table support 114, lock assemblies 124, a table riser 128, legs 147,148, and 149, table lift assemblies 150, and a rotary union 160.

The three legs 147, 148, and 149 form the foundation of the indexing assembly 100, respectively located at station 2, station 3, and station 4. Supported by legs 147,148, and 149, the table riser 128 comprises an inner ring 130 and an outer ring 132 defining an annular gap therebetween. Tracks 134 run parallel along respective interior faces of the inner ring 130 and outer ring 132. The tracks 134 contain ball bearings 136 providing a sliding surface around the table riser 128 to support the table lift assemblies 150.

The table lift assemblies 150, best seen in FIG. 2 include hydraulic cylinders 151 vertically mounted between a base 152 and the table support 114 for raising and supporting the table support 114 and indexing table 102. The base 152 engages the tracks 128 so that each table lift assembly 150 can freely glide around the annular gap of the table riser 128. In operation, the cylinders 151 extend to lift the table support 114 and indexing table 102 to an indexing position and retract to lower the table support 114 and indexing table to a stationary position. A guide rod 156 extending upwards from the base 152 couples with respective holes 105 and 116 of the table support 114 and indexing table 102 to guide them between the stationary and indexing position. In addition, table bosses 158 are positioned along a top edge of the outer ring 132 of the table riser 128. The table bosses 158 engage a bottom face of the table support 114 to accurately position the indexing assembly 100 in the stationary position. While the present embodiment discloses four table lift assemblies 150, any number and arrangement of assemblies 150 which can sufficiently lift and support the table support 114 and indexing table 102 can be used.

The table support 114 is a circular ring that attaches to a bottom face of the indexing table 102 to provide support. A pair of lock assemblies 124 are positioned within the body of the table support 114 at four mating locations, one at each station, to engage each die block assembly 200. Each lock assembly 124 comprises a rack 125 juxtaposed with two collars 126. The collars 126 include gear teeth along the outside surface, which engage corresponding gear teeth along the rack 125. Together, the rack 125 and collars 126 operate like a rack and pinion. Channels 120 within the body of the table support 114 allow lock cylinders 146 to engage the rack 125. The lock cylinders 146 are mounted to supports 144 extending from the table riser 128. During operation, the lock cylinders 146 slide the rack 125 back and forth to lock and unlock the collars 126 around lock pins 218 of the die block assembly 200, to be described in more detail below. In the present embodiment, multiple collars 126 are used to accommodate different sizes and types of die tool assemblies 200. However, those skilled in the art will recognize that collars 126 and racks 125 can be added or removed to accommodate a countless number of sizes and shapes of die tool assemblies 200. The table support 114 has an outer rim having a plurality of gear teeth 122 along and around the outer rim. During operation, a motor 123 engages the gear teeth 122 to rotate the table support 114 and the supported indexing table 102.

The indexing table 102 is a circular plate with hole patterns 104 for mating with each die block assembly 200, at each mating location. In the present embodiment, there are four sets of identical hole patterns 104 and mating locations, one for each station. At the center of each hole pattern 104 is a clearance hole 106 for the shot sleeve assembly 500. Positioned around the clearance hole 106 is a hole 105 for a guide rod 156, holes 108 for lock pins 218, holes 110 for splitter pins 222, and holes 112 for ejector pins 210. Multiple sets of holes are used to accommodate different sizes and types of die tool assemblies 200. However, those skilled in the art will recognize that any number and arrangement of hole patterns 104 can be used.

The rotary union 106 is mounted at the center of the indexing table 102 to provide a rotary connection between hydraulic, water, and oil supply lines and the various assemblies that rotate with the indexing assembly 100. Any typical rotary union can be used, which are known to those skilled in the art.

In operation, the indexing assembly 100 conveys the die block assembly 200 between stations by "indexing" every fifteen seconds. For purposes of this specification, "indexing" is defined as advancing each die block by one station. Before indexing, the indexing assembly 100 rests in the stationary position as described above with cylinders 151 retracted and the table support 114 and indexing table 102 supported by the table riser 128. To index the assembly 100 in the present embodiment, the cylinders 151 extend, which raises the table support 114 and index table 102 about 1" to the indexing position. The motor 123 engages teeth 122 of the table support 114 and rotates the table support 114 and indexing table 102 clockwise, thereby, advancing each die block 200 by one station, which is about 90° in the present embodiment. Next, the cylinders 151 retract, which lowers the table support 114 and index table 102 back to the stationary position.

Figure 3:
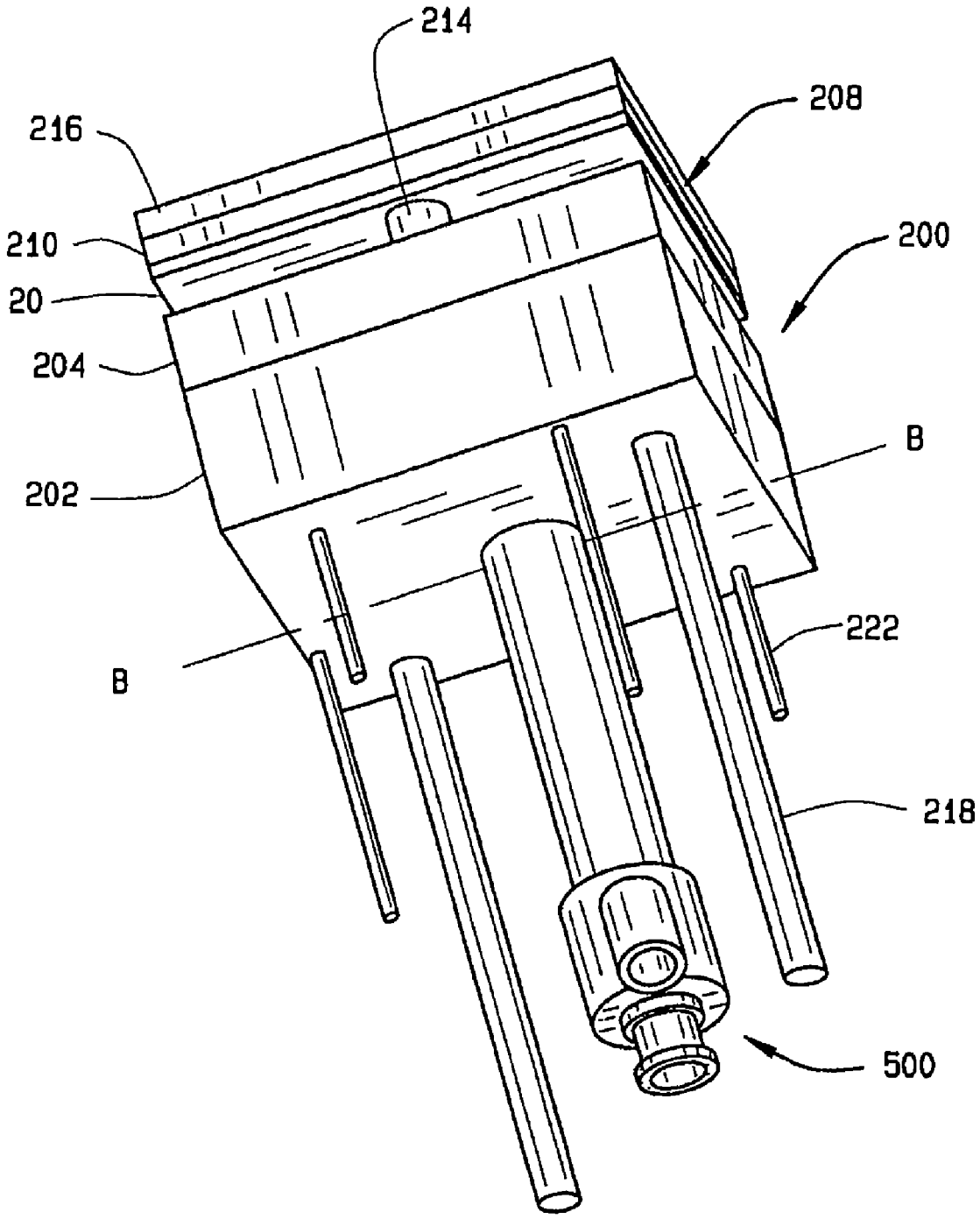
FIG. 3 is a perspective view of a die tool assembly.
Figure 5:
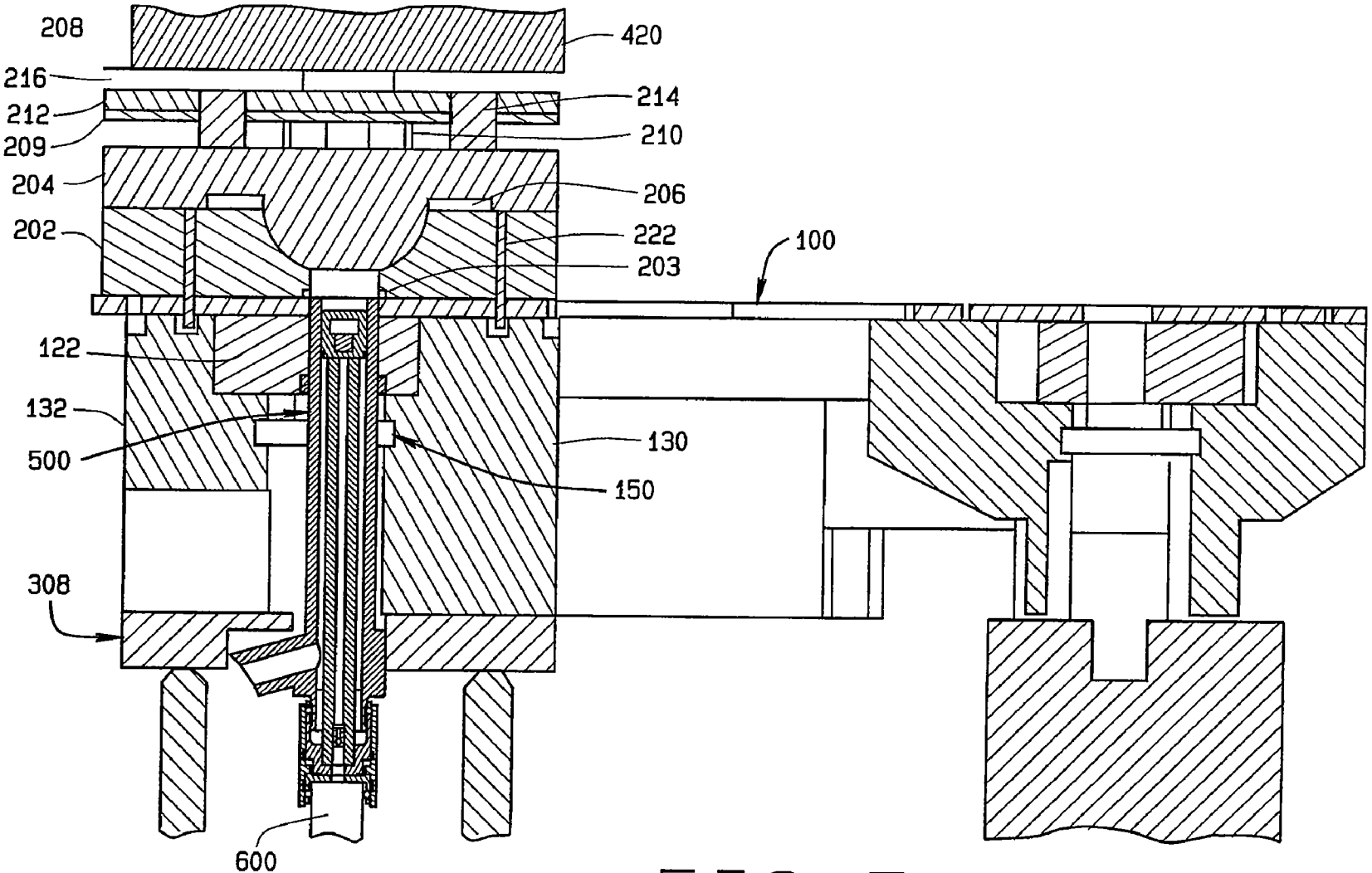
FIG. 5 is an enlarged section view, partly broken away along line A-A in FIG. 1.

Illustrated in FIGS. 3 and 5, the die block assembly 200 is essentially a generally rectangular block that includes a bottom half 202 and an ejector half 204 (the upper half of the die), which mate together to form a cavity 206. It is important to note that the shape of the cavity 206 determines the shape of the finished part. Those skilled in the art will recognize that the cavity can be any appropriate shape. In the present embodiment, each die block assembly 200 may have a different cavity shape to produce a different finished part. This allows the apparatus 10 to produce multiple parts in a single production run. The bottom half 202 defines a counterbore 203 for receiving the shot sleeve assembly 500, to be described in more detail below. Lock pins 218 extend downwardly from the ejector half 204 through bushings in the bottom half 202. During operation, the lock pins 218 can be raised or lowered to separate or mate the ejector half 204 with the bottom half 202. Splitter pins 222 slidably attach to the bottom half through bushings. During operation, the splitter pins 222 raise until they protrude through the top face of the bottom half 202, thereby, striking the ejector half 204 and separating it from the bottom half 202.

Figure 13A:
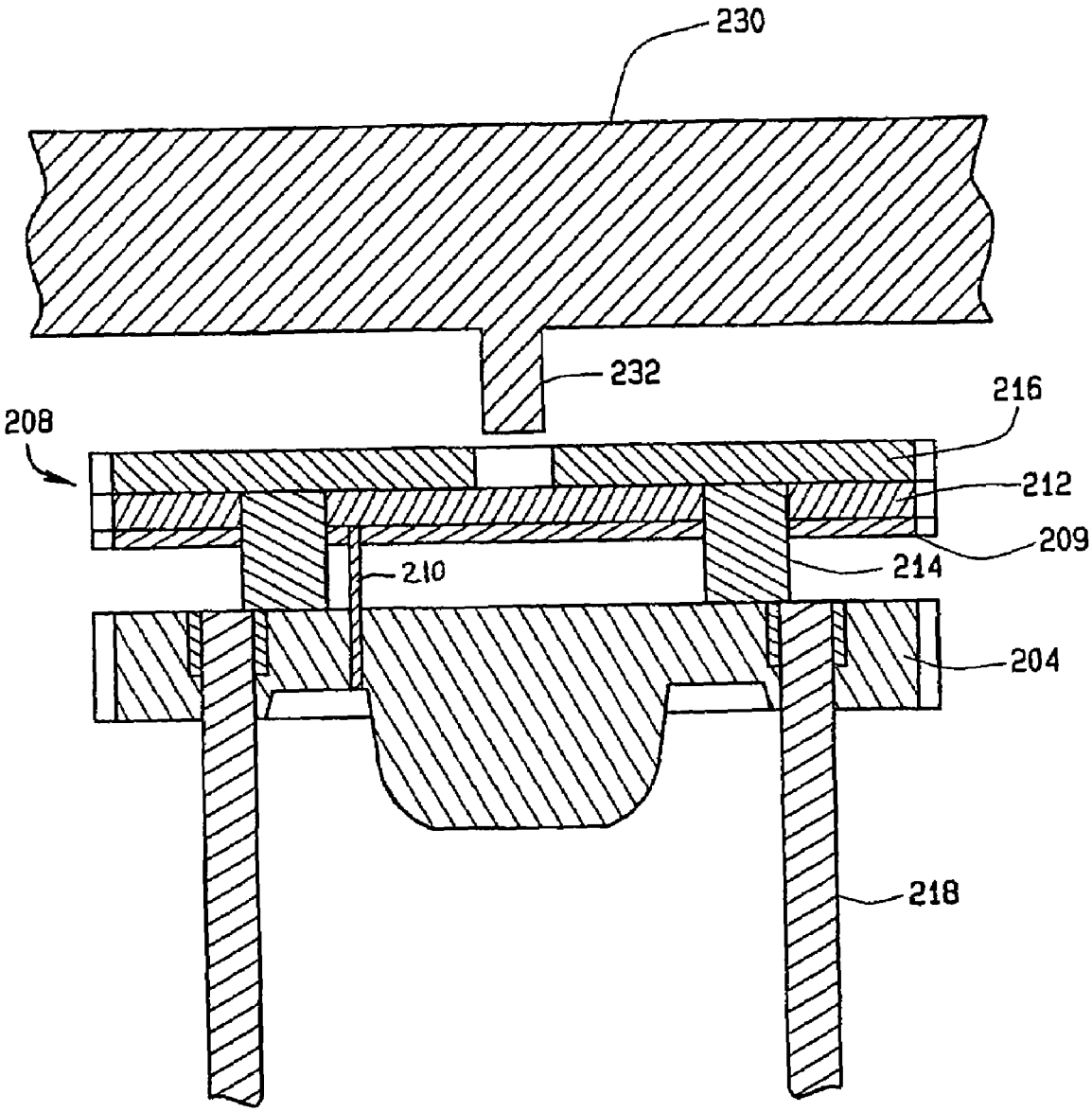
FIG. 13A is a section view of the die block assembly along line B-B of FIG. 3 about to strike a knockout beam.
Figure 13B:
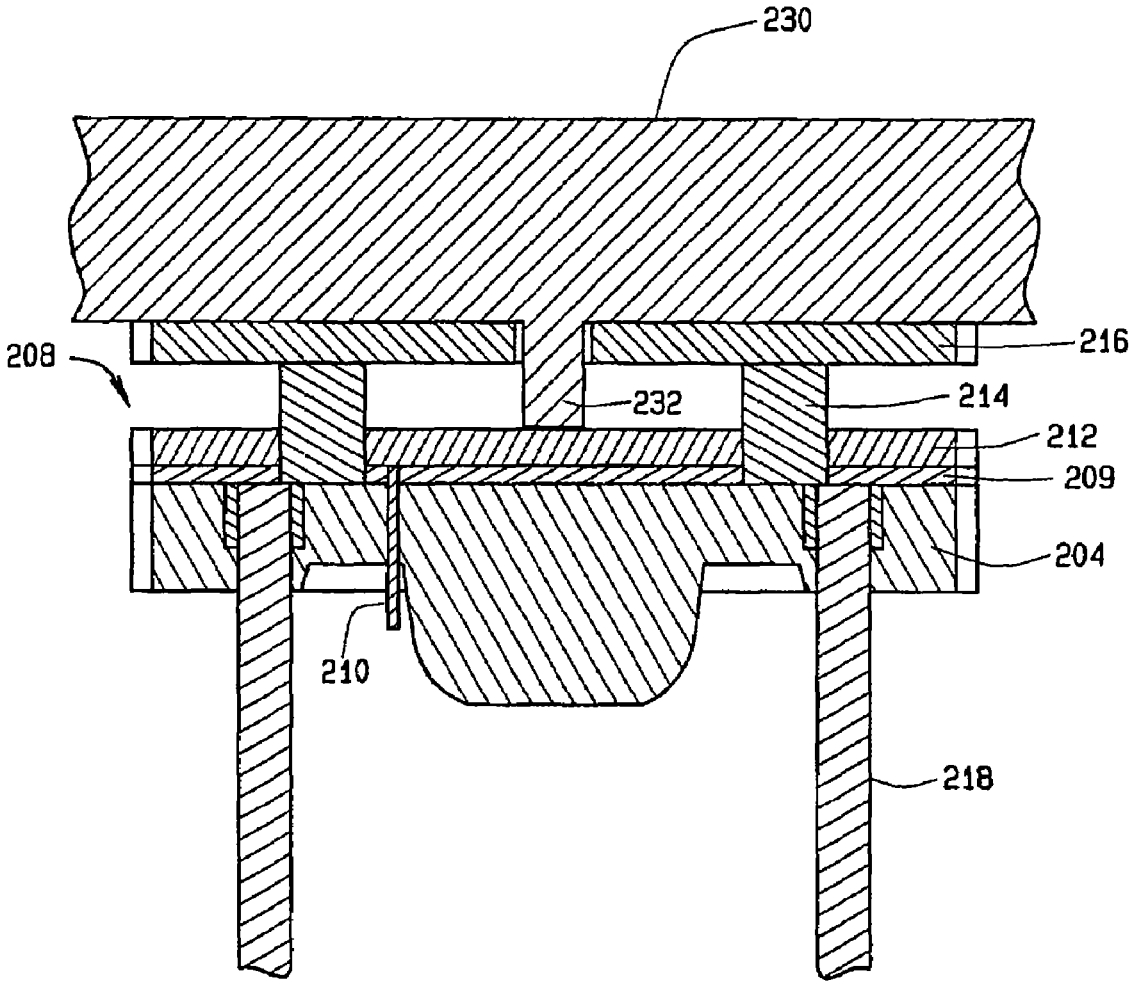
FIG. 13B is a section view of the die block assembly along line B-B of FIG. 3 after striking the knockout beam.

As shown in FIGS. 13A and 13B, an ejector assembly 208 attaches to the top face of the ejector half 204 for ejecting finished parts from the die block 200 at station 3. The ejector assembly 208 comprises a retainer plate 209, a backup plate 212, and a clamp plate 216. The retainer plate 209 is a rectangular plate with ejector pins 210 extending downwardly. The backup plate 212 is a rectangular plate attached to the top face of the retainer plate 209 for providing support. The clamp plate 216 is a rectangular plate with support pillars 214 extending downwardly from a bottom face. The pillars 214 extend through the backup plate 212 and retainer plate 209 and attach to the top face of the ejector half 204 so that the backup plate 212 and retainer plate 209 can slide up and down along the pillars 214. During operation, the ejector half 204 and ejector assembly 208 move upwards until the clamp plate 216 strikes a knockout beam 230. As shown in FIG. 13B, a stop 232 of the beam 230 strikes the backup plate, thereby, pushing the backup plate 212 and retainer plate 209 downwards against the ejector half 204. In this position, the ejector pins 210 protrude through the bottom face of the ejector half 204 to eject finished parts.

Illustrated in FIGS. 5, and 9-11B, the shot sleeve assembly 500 includes a shot sleeve 502, a shot rod 506, and a coupler 512. The shot sleeve 502 is a hollow tube with a cover flange 503 near the upper end and a coupler flange 504 at the lower end. The coupler flange 504 includes an annular groove 509 that receives locking balls 528 for coupling with the coupler 512, and an inlet port 505 for coupling with a conduit 312.

The conduit 312 communicates molten material from a suitable furnace or source of material and is a gooseneck shape to prevent leaking of material when disconnected from the coupler flange 504. The conduit 312 includes a heating element 313 to prevent hardening of the molten material within the conduit 312. Otherwise, hardened material can interfere with flow through the conduit 312 and proper sealing with the inlet port 505.

The shot sleeve assembly 500 engages the bottom half 202 of the die block assembly 200 by inserting the shot sleeve 502 into the counterbore 203 so that the cover flange 503 seats against the counterbore 203 and the tip of the shot sleeve 502 is flush with the bottom of the cavity 206. It is important to note that the shot sleeve assembly 500 and die block assembly 200 remain coupled together as the indexing assembly 100 indexes around the stations.

The shot rod 506 is a tube with a hollow core 507 and includes a plunger tip 508 capping the upper end, and a diverter 510 near the lower end for communicating cooling water between waterlines 511 and the hollow core 507. The shot rod 506 inserts into the shot sleeve 502 so that the plunger tip 508 seals against the inner wall of the shot sleeve 502. The shot rod 506 slides up and down within the shot sleeve 502 to inject molten material into the die block assembly 200. A vertical shot cylinder 600, to be described in further detail below, controls the stroke of the shot rod so that the molten material is injected into the die block assembly 200 at a controlled pressure and flow rate.

Figure 11A:
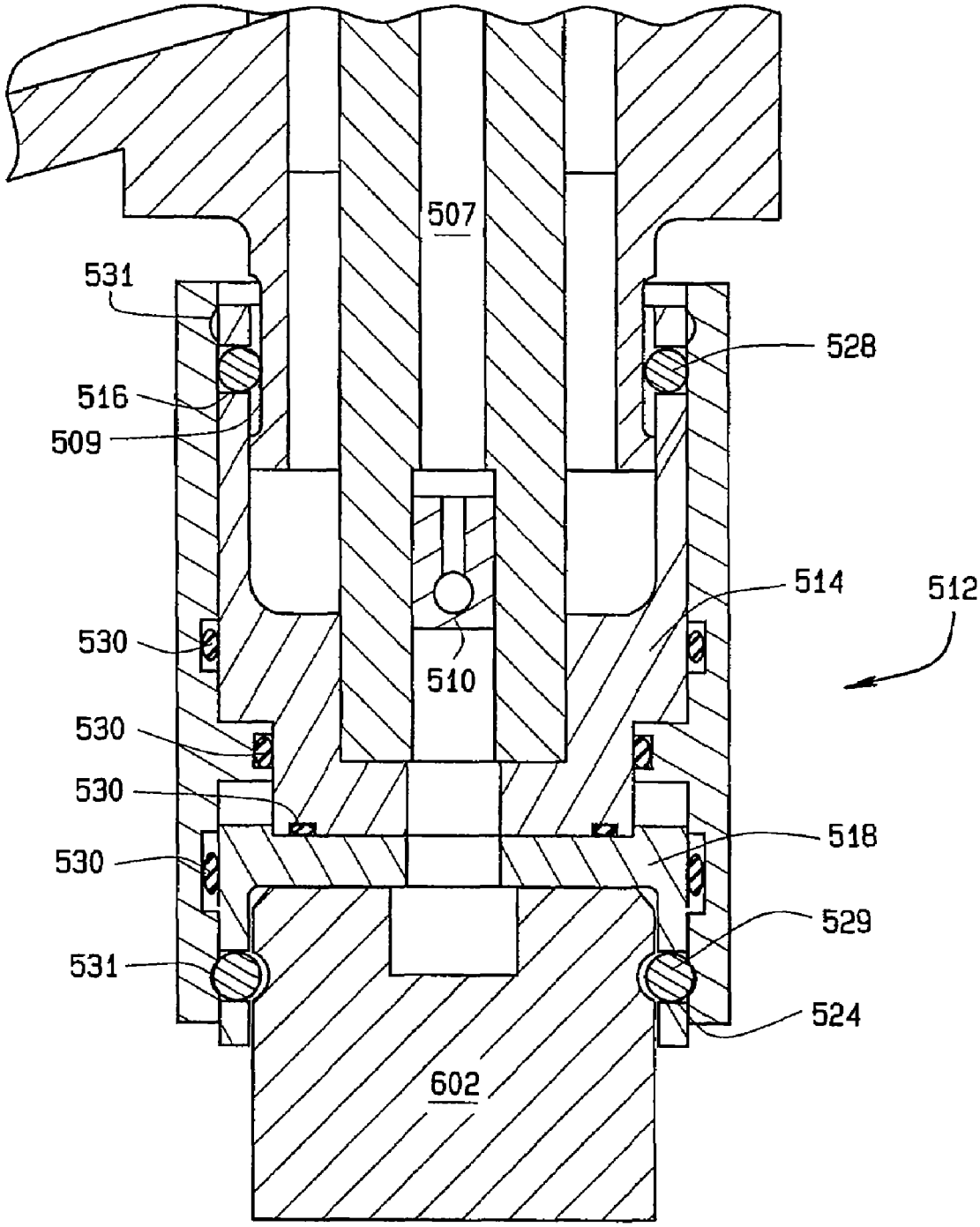
FIG. 11A is a section view of a coupler employed with the shot sleeve assembly of FIG. 10 with an upper connector in a coupled position and a lower connector in an uncoupled position.
Figure 11B:
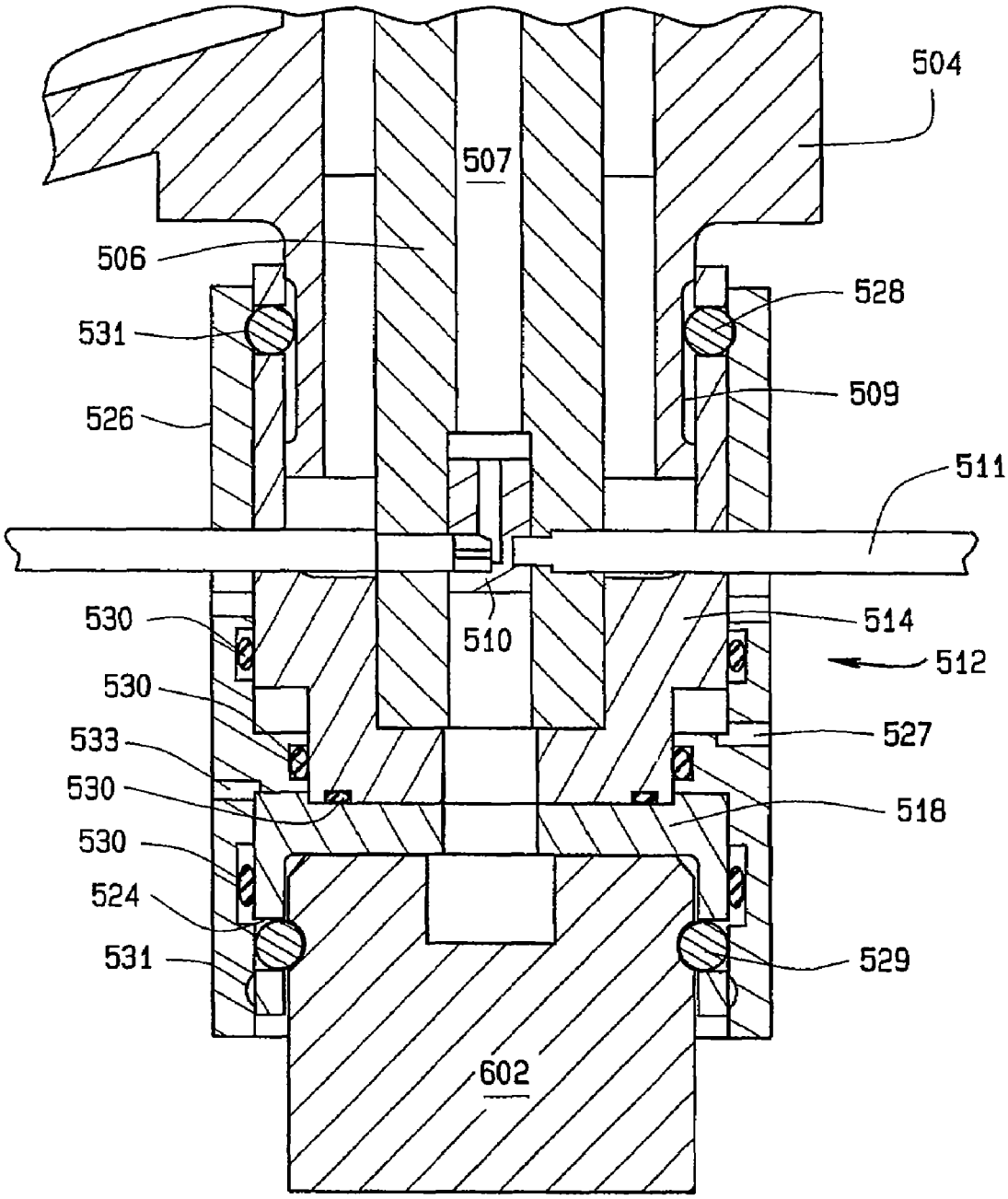
FIG. 11B is a section view of the coupler with the upper connector in an uncoupled position and the lower connector in a coupled position.

The coupler 512 removably couples the shot sleeve assembly 500 with the vertical shot cylinder 600. The coupler 512 comprises an upper connector 514 and a lower connector 518 surrounded by an outer actuator 526. The outer actuator 526 is a cylindrical ring with inlet ports 527 and 533 for receiving hydraulic fluid and ball depressions 531 for receiving locking balls 528 and 529. The upper connector 514 is cylindrical ring with ball holes 516 for receiving locking balls 528. The upper connector 514 slides up and down within the outer actuator 526 to couple with the coupler flange 504 of the shot sleeve 502. In operation, a supply line communicates hydraulic fluid to the inlet port 527 of the outer actuator 526 to slide the upper connector 514 up and down between respective coupled and uncoupled positions. FIG. 11A shows the upper connector 514 in the coupled position with the locking balls 528 locked into the annular groove 509 of the coupler flange 504, thereby coupling the coupler 512 with the shot sleeve 502. FIG. 11B shows the upper connector 514 in the uncoupled position with the locking balls 528 recessed into the depression holes 531 of the outer actuator 526.

The lower connector 518 is also a cylindrical ring with ball holes 524 for receiving locking balls 529 for coupling with the vertical shot cylinder 600. The lower connector 518 slides up and down within the outer actuator 526 to couple with a coupling tip 602 of the vertical shot cylinder 600. In operation, a supply line communicates hydraulic fluid to the inlet port 533 of the outer actuator 526 to slide the lower connector 518 up and down between respective uncoupled and coupled positions. FIG. 11A shows the lower connector 518 in the uncoupled position with the locking balls 529 recessed into the depression holes 531 of the outer actuator 526. FIG. 11B shows the lower connector 518 in the coupled position with the locking balls 529 locked into an annular groove 604 of the coupling tip 602, thereby coupling the vertical shot cylinder 600 with the shot sleeve 502. If necessary, a number of O-rings 530 may be used within the coupler 512 for sealing.

Figure 14:
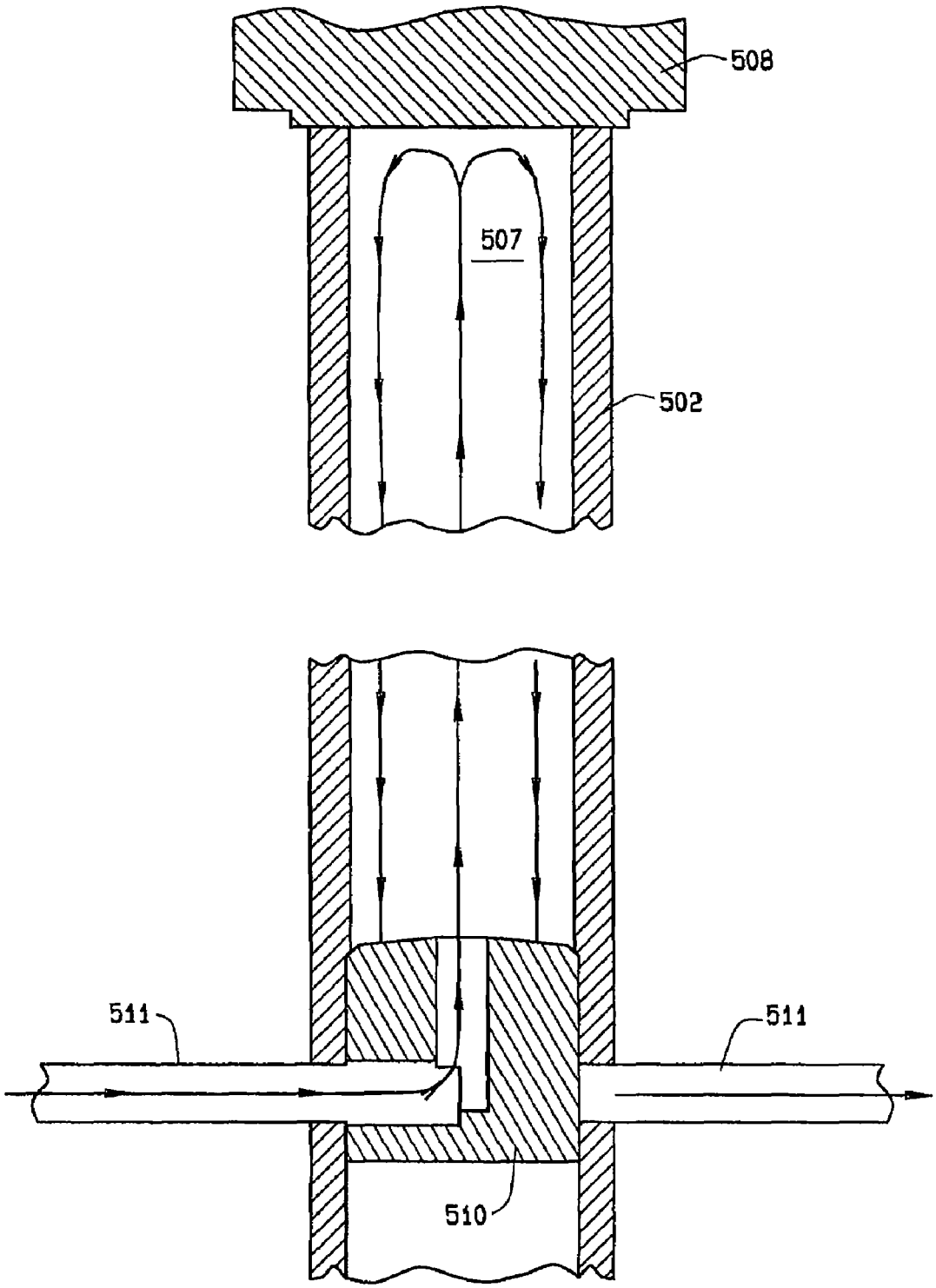
FIG. 14 is an enlarged section view of the shot sleeve shown in FIGS. 9 and 10 illustrating cooling water flow.

Cooling water is continuously circulated through the shot sleeve assembly 500 to regulate the high temperatures occurring during operation. The waterlines 511 communicate cooling water through diverter 510 and the core 507 of the shot rod 506. As illustrated in FIG. 14, cooling water flows through the core 507 in a fountain-like pattern, with water initially flowing upwards along the interior of the core 507 and flowing downwards along the exterior of the core 507.

As illustrated in FIGS. 1 and 4, station 1 includes the frame assembly 300 and the clamp assembly 400. First addressing the frame assembly 300, it includes an upper platen 302, tie rods 304, collars 306, a lower platen 308, and a vertical shot cylinder 600. The upper platen 302 and lower platen 308 are rectangular enclosures connected at each end by tie rods 304, which are held in place by collars 306. The vertical shot cylinder 600 mounts within the body of the lower platen 308 and includes a coupling tip 602 that couples with the shot sleeve assembly 500 as described above.

Figure 6:
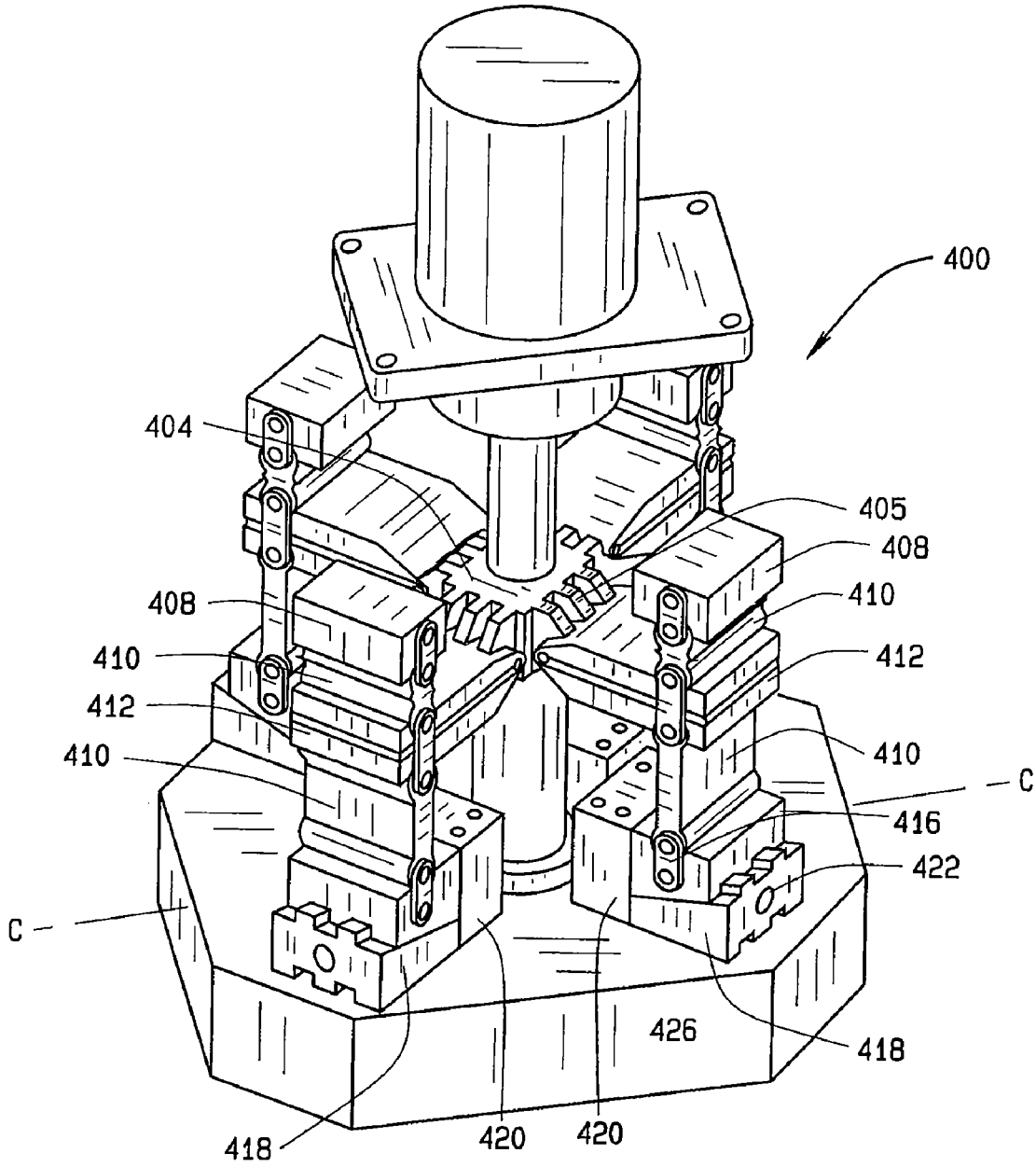
FIG. 6 is a perspective view of a clamp assembly.
Figure 7:
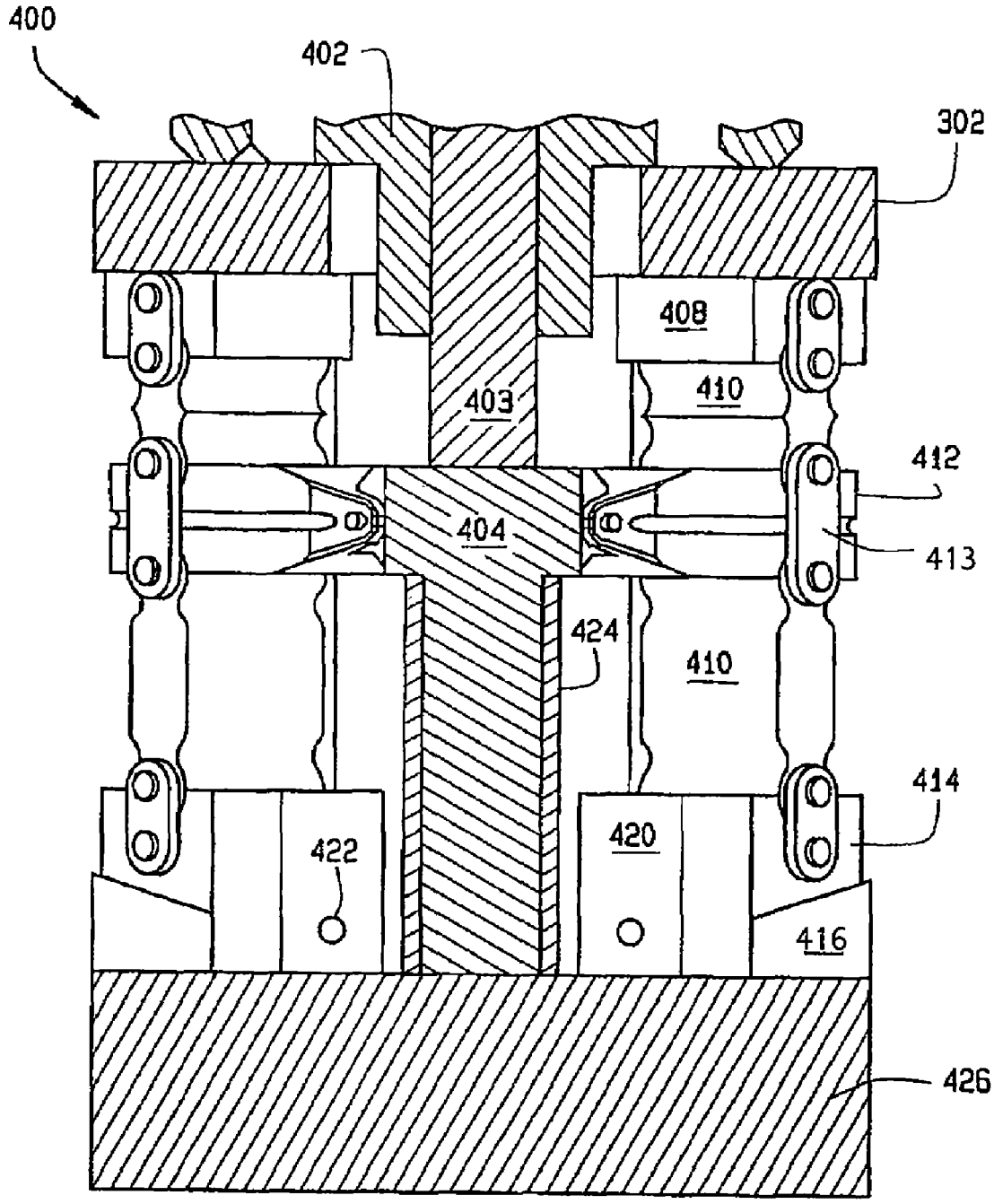
FIG. 7 is a section view, partly broken away, along line C-C in FIG. 6 of the clamp assembly.
Figure 8:
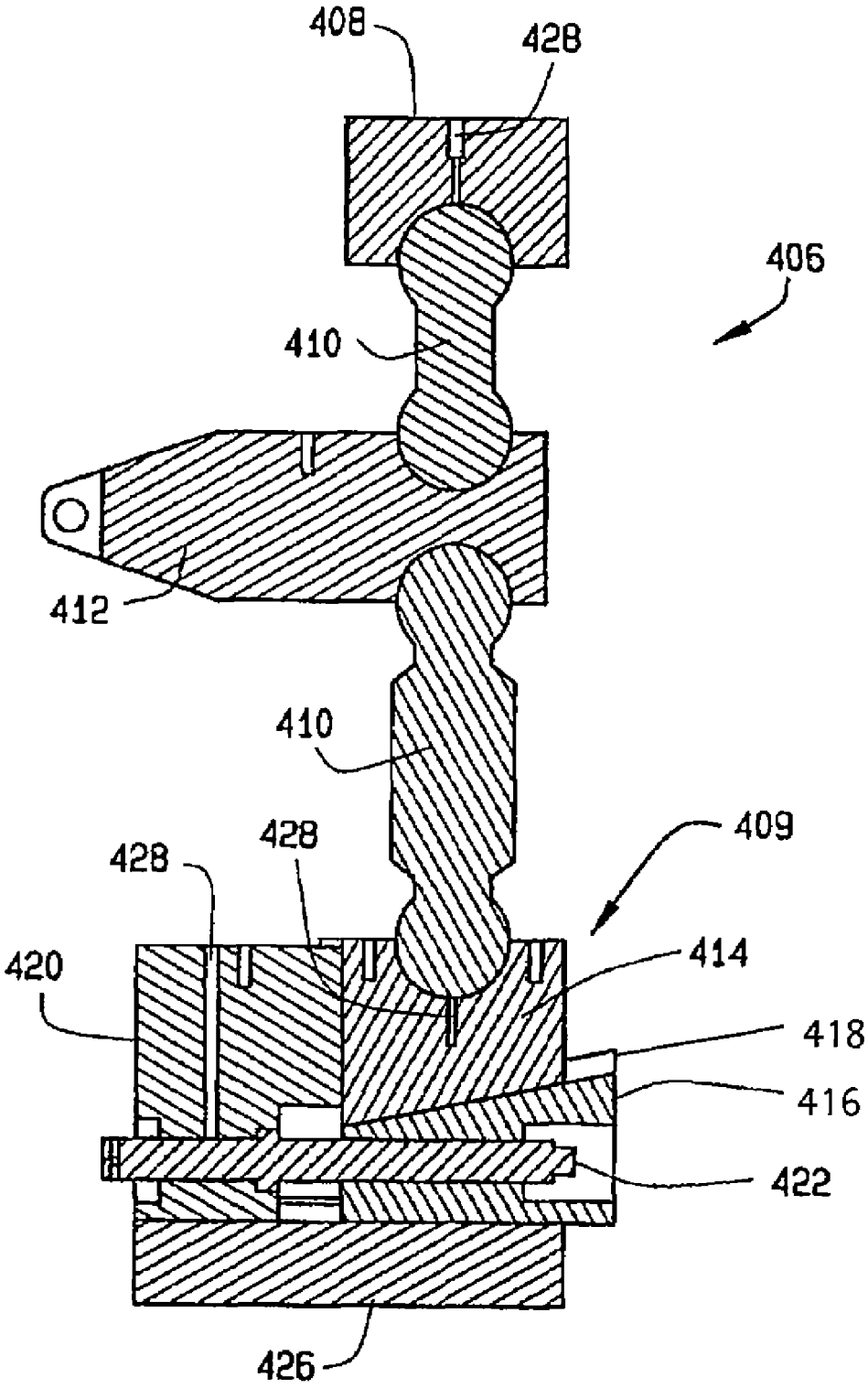
FIG. 8 is a section view of a toggle assembly.

Next, the clamp assembly 400 illustrated in FIGS. 6-8 extends and retracts to clamp and release the die tool assembly 200 within station 1. The assembly 400 includes an actuation cylinder 402 vertically mounted within the upper platen 302 with a piston 403 of cylinder 402 extending downward. The piston 403 is attached to a connector 404. The connector 404 is a straight rod with teeth 405 extending outward from the top end for pivotally engaging with four toggle assemblies 406. The toggle assembly 406 operatively connects the connector 404 and upper platen 302 with a moving platen 426. The moving platen 426 is a rectangular plate with a cylindrical bearing 424 attached to the center of the top face for engaging the connecter 404.

Each toggle assembly 406 includes an upper pressure block 408 attached to the bottom face of the upper platen 302 and a lower pressure block assembly 409 attached to the top face of the moving platen 426 for adjusting the compression load on each toggle assembly 406 that occurs during clamping, which will be described in further detail below. Toggles 410 pivotally attach to respective upper pressure block 408 and lower pressure block assembly 409 with a central toggle 412 pivotally interposed between both toggles 410 using links 413. The central toggle 412 extends more or less horizontally to pivotally engage the connector 404. The present embodiment uses four toggle assemblies 406 to insure that the moving platen 302 remains stable during operation. However, those skilled in the art will recognize that any number of toggle assemblies 406 can be used to stabilize the moving platen 302.

As indicated, the lower pressure block assembly 409 includes a tapered upper block 414 operatively connected to a tapered lower block 416 by dovetail guides 418 located along tapered faces of the blocks 414 and 416 so that the compression load on the toggle assembly 406 is adjustable. Both blocks 414 and 416 are juxtaposed against a lead screw block 420, which is secured to the moving platen 426. The lower tapered block 416 adjusts inwards and outwards relative to the clamp assembly 400 with a lead screw 422 threaded through the lower block 416 and the lead screw block 420. As the lower block 416 is adjusted inwards, the dovetail guides 418 force the upper block 414 upwards, thus, increasing the overall length of the toggle assembly 406 and increasing the compression load of the toggle assembly 406 during clamping. As the lower block 416 is adjusted outwards, the dovetail guides 418 force the upper block 414 downwards thus, decreasing the overall length of the toggle assembly 406 and decreasing the compression load of the toggle assembly 406 during clamping. Each block assembly 409 is independently adjustable to compensate for uneven forces among the toggle assemblies 406, which can be caused by variations in the height of the die block assembly 200. Therefore, each block assembly 409 is adjusted so that the compression load on each toggle assembly 406 is equal.

In operation, the actuation cylinder 402 extends and retracts to clamp and release the moving platen 302 with the die tool assembly 200. The actuation cylinder 402 extends lowering the connector 404 and locking the toggle assembly 406 into place by vertically aligning the toggles 410 with the central toggle 412 nearly perpendicular to the toggles 410, referred to as clamping position. In this position, the moving platen 302 presses down against the ejector clamp plate 216, thus, compressing the die block assembly 200. In this way, the toggle assembly 406 acts as a force multiplier capable of multiplying the force of the actuation cylinder 402, about 2,000 psi, by about 14 times. In the present embodiment, the clamp assembly 400 places about 1600 tons of force onto the tool block assembly 200. To prevent mechanical failure of the toggle assembly 406, these large forces are transferred through the toggle assembly 406 to the upper platen 302 via the upper pressure block 408. As a result, the toggle assembly 406 carries only very low compression loads with virtually no shear loads. In fact, the unique design of the clamp assembly 400 results in only compression loads with virtually no shear loads in all of the parts in the clamp assembly 400. When the actuation cylinder 402 retracts, the connector 404 raises the central toggle 412 unlocking the toggle assembly 406 and raising the moving platen, referred to as the release position. In the present embodiment, the moving platen 302 has a travel of about 1½", providing sufficient clearance between the die block assembly 200 and the clamp assembly 400 to allow indexing of the indexing assembly 100 when in the release position.

In an alternate embodiment, the clamping assembly 400 comprises a typical long stroke clamp, which are known by those of ordinary skill in the art.

To provide lubrication to all moving parts within the clamping assembly 400, lubrication lines 428, which are in fluid communication with a central lubber, are strategically located throughout the clamp assembly 400.

Figure 12:
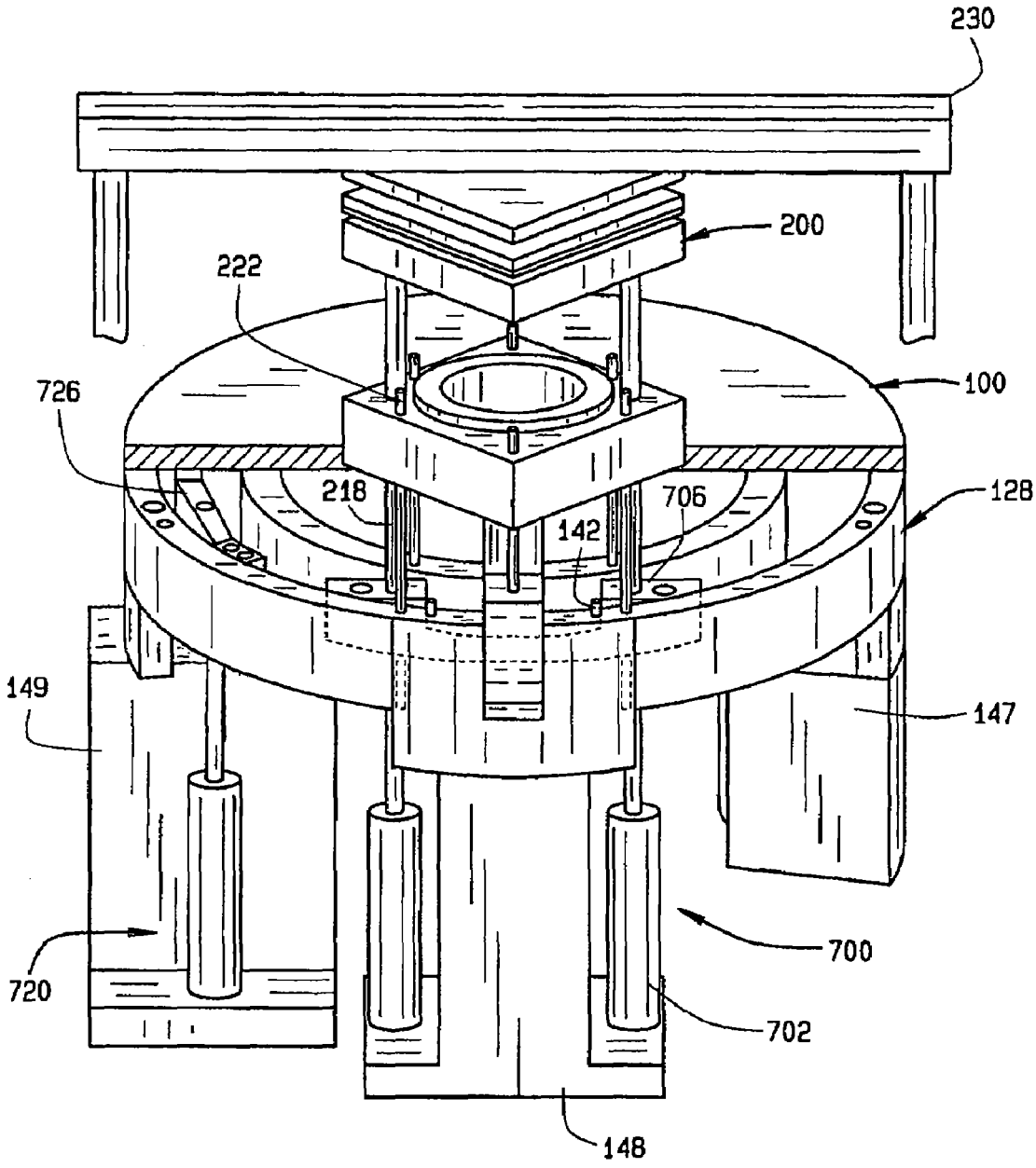
FIG. 12 is a partial perspective view of Station #3 of the die casting apparatus.

Illustrated in FIG. 12, the ejector lift assembly 700 is located at station 3 and includes lift cylinders 702 vertically mounted to leg 148 and attached to a lift beam 706. The lift beam 706 defines a center clearance hole 708 for clearing the shot sleeve assembly 500 and locating holes 710 for engaging the lock pins 218 of the die block assembly 200. In operation, the lift cylinders 702 extend to raise the lift beam 706 until the locating holes 710 of the lift beam 706 engage the lock pins 218. The lift cylinders 702 continue to extend raising the lock pins 218, the ejector half 204, and the ejector assembly 208 until they strike the knockout beam 230 for ejecting finished parts as described above.

Also illustrated in FIG. 12, the ejector drop assembly 720 is located at station 4 and is structurally identical to the ejector lift assembly 700, but differs in function. Instead of raising the lock pins 218, the ejector half 204, and the ejector assembly 208, the ejector half drop 750 lowers those parts. The ejector drop 720 includes lift cylinders 722 vertically mounted to leg 149 and attached to a lift beam 726. The lift beam 726 defines a center clearance hole 728 for clearing the shot sleeve assembly 500 and locating holes 730 for engaging the lock pins 218 of the die block assembly 200. In operation, the lift cylinders 722 retract lowering the lift beam 706 until the locating holes 730 of the lift beam 726 disengage the lock pins 218.

Figure 16:
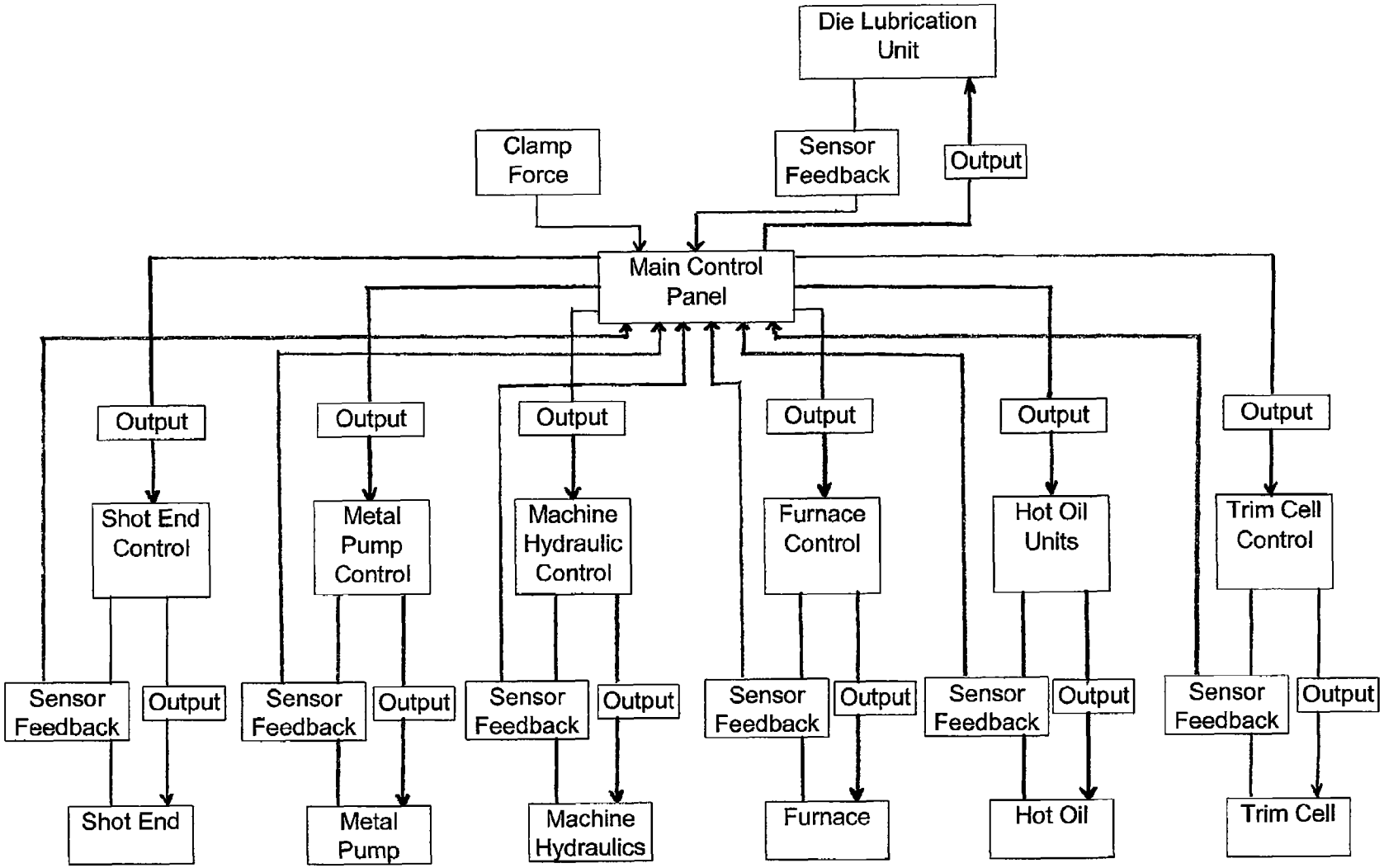
FIG. 16 is a block diagrammatic view of an electrical system of the die casting apparatus.

The following is a description of the operation of the die casting apparatus 10 beginning with station 1 and progressing to station 4. For references purposes, FIG. 15 is a timetable detailing the timing of events as they occur at each station. In addition, the timing and operation of each station is controlled by electrical communication with a control panel 740 as illustrated in FIG. 16.

Before operation of the die casting apparatus 10 begins, four die block assemblies 200 are placed on the indexing assembly 100. One die block assembly 200 is placed into a hole pattern 104 at each mating location of the indexing table 102. At the discretion of the operator, each die block assemblies 200 may have a cavity 206 to produce a different part or all die block assemblies 200 may have a cavity 206 to produce the same part.

At injection station 1, the die block assembly 200 begins in a closed position. In this position, the ejector half 204 mates with the bottom half 202 forming the cavity 206. In addition, the lock assemblies 124 are locked with the lock pins 218, thereby, placing a preload on the die block assembly of about 50,000 psi. The indexing assembly 100 begins in the stationary position and the shot sleeve assembly 500 is coupled with the die block assembly 200 and the vertical shot cylinder 600. Also, the conduit 312 is engaged with the inlet port 504 of the shot sleeve 502 for communicating molten material from a suitable furnace or source of material.

Figure 10:
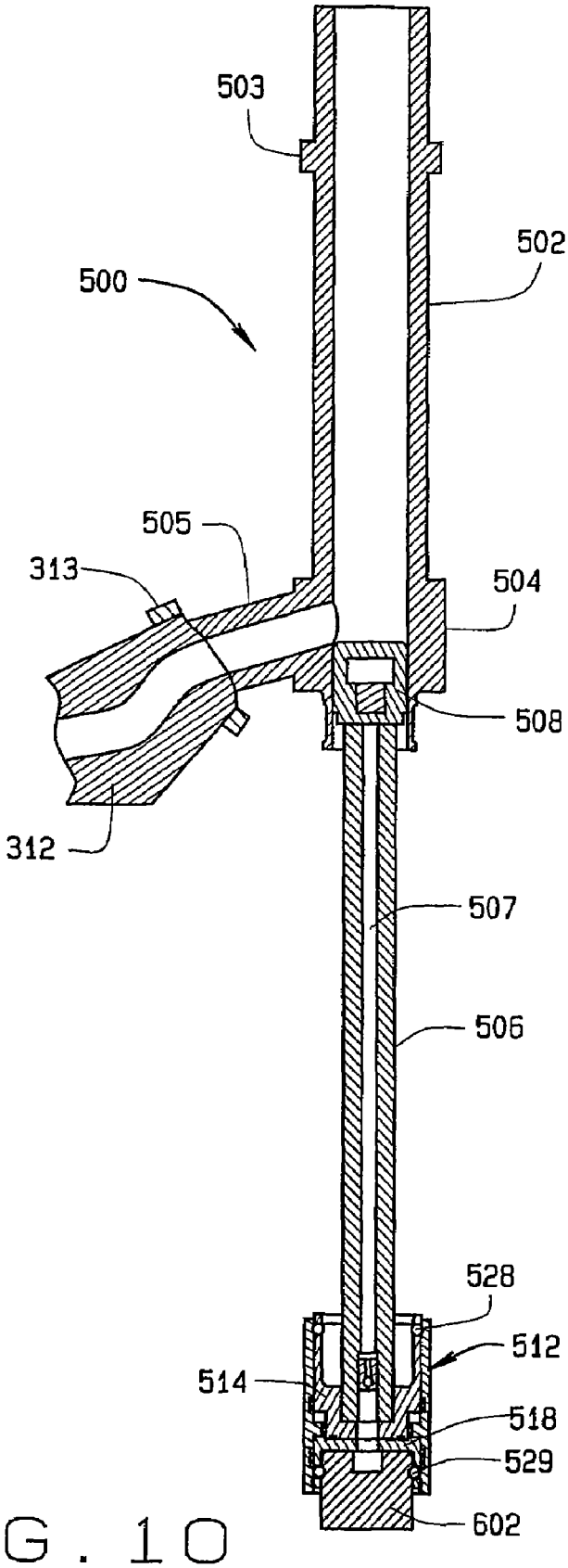
FIG. 10 is a section view along line A-A in FIG. 1 of a shot sleeve assembly in a retracted position.

Beginning the operation, the clamp assembly 400 extends to the clamping position, thereby, placing about 1600 tons of force onto the die block assembly 200. The vertical shot cylinder 600 extends and couples to the shot sleeve 500 via the coupler 512. The vertical shot cylinder 600 retracts pulling the shot rod 506 and plunger 508 to a retracted position. As illustrated in FIG. 10, molten material is communicated from the conduit 312 into the shot sleeve 502 by an appropriate means, such as a pump. The vertical shot cylinder 600 extends the shot rod 506 and plunger tip 508, thereby, injecting a "shot" of molten material into the cavity 206 of the die block assembly 200. The vertical shot cylinder 600 also extends to hydraulically pressurize the molten material inside the cavity 206, a process referred to as "intensification". Intensification of the liquid material inside the cavity forms a denser finished casting and reduces the porosity of the finished casting. It is important to note that the control panel controls and coordinates the amount of material pumped into the shot sleeve 502 and the travel of the vertical shot cylinder 600 to accommodate different size cavities 206. The coupler 512 of the shot sleeve assembly 500 uncouples from the vertical shot cylinder 600 and retracts and the clamp assembly 400 retracts to a release position. At the end of this approximately 15 second process, the indexing assembly 100 indexes the die block assembly 200 to station 2. As the indexing assembly 100 indexes, the shot sleeve assembly 500 remains with the die block assembly 200.

At cooling station 2, the injected material within the die block assembly 200 cools until it solidifies into a solid part. The cylinders 146 extend to engage the lock assemblies 124 and unlock the lock pins 218, thereby, releasing the preload on the die block assembly 200. Subsequently, the cylinders 146 retract to their original position. At the end of this approximately 15 second process, the indexing assembly 100 indexes the die block assembly 200 to station 3.

At ejection station 3, the finished part is removed from the die block assembly 200. When the indexing assembly 100 lowers the die block assembly 200 onto station 3, the splitter pins 222 strike against the table riser 128, including the arms 138. As a result, the splitter pins 222 protrude through the top face of the bottom half 202 splitting the ejector half 204 from the bottom half 202. After the split, the finished part will separate from the bottom half 202 and stick to the ejector half 204. The lift cylinders 702 of the lift assembly 700 extend, thereby, engaging the lock pins 218. The lift cylinders 702 continue to extend raising the lock pins 218, ejector half 204, and ejector assembly 208 until the clamp plate 216 strikes the knockout beam 230. As shown in FIG. 13B, a stop 232 of the beam 230 strikes the backup plate, thereby, pushing the backup plate 212 and retainer plate 209 downwards against the ejector half 204. In this position, the ejector pins 210 protrude through the bottom face of the ejector half 204 to eject finished parts. When ejected, the finished part is grabbed and removed by a robotic arm (not shown) or other appropriate means. Afterwards, lift cylinders 702 retract slightly backing the ejector assembly 208 off the knockout beam 230 and the cylinders 146 extend to engage the lock assemblies 124 and lock the lock pins 218 and the ejector half 204 in an open position. The lift cylinders 702 fully retract, disengaging the lift beam 706 from the lock pins 218 and the cylinders 146 retract. At the end of this approximately 15 second process, the indexing assembly 100 indexes the die block assembly 200 to station 4.

After removal of the finished part by the robotic arm, secondary operations are performed on the finished part while the machine continues to operate without interruption. Secondary operations may include inspection and trimming operations. Preferably, inspection of finished parts should be performed immediately after removal so that any defects or undesirable variations can be detected before the die apparatus 1 produces additional defective parts.

At recovery station 4, the die block assembly 200 is recovered for use in another cycle. Using appropriate means, such as a hose with nozzle, the die block assembly 200 is sprayed with a cooling agent, such as water, and blown-off. In necessary, a release agent is sprayed onto the die block assembly 200 to aid with part removal. The lift cylinders 722 of the ejector drop assembly 720 extend raising the lift beam 726 until it engages the lock pins 218. Cylinders 146 engage the lock assemblies 124 to unlock the lock pins 218. The lift cylinders 722 retract by gravity, thereby, lowering the die block assembly 200 to a closed position. Cylinders 146 engage the lock assemblies 124 to lock the lock pins 218 placing a preload on the die block assembly 200. At the end of this approximately 15 second process, the indexing assembly 100 raises and indexes the die block assembly 200 to station 1 to restart another cycle.

In the present embodiment, multiple die cast apparatus 10 can be used in conjunction with a single or multiple furnaces. This allows great flexibility in the size of production runs.

Many variations of the die casting apparatus 10 can be made without departing from the scope of the invention. Several alternate embodiments are shown in FIGS. 17-25. For ease of understanding, components common between the various embodiments are identified with matching reference numbers.

Figure 17:
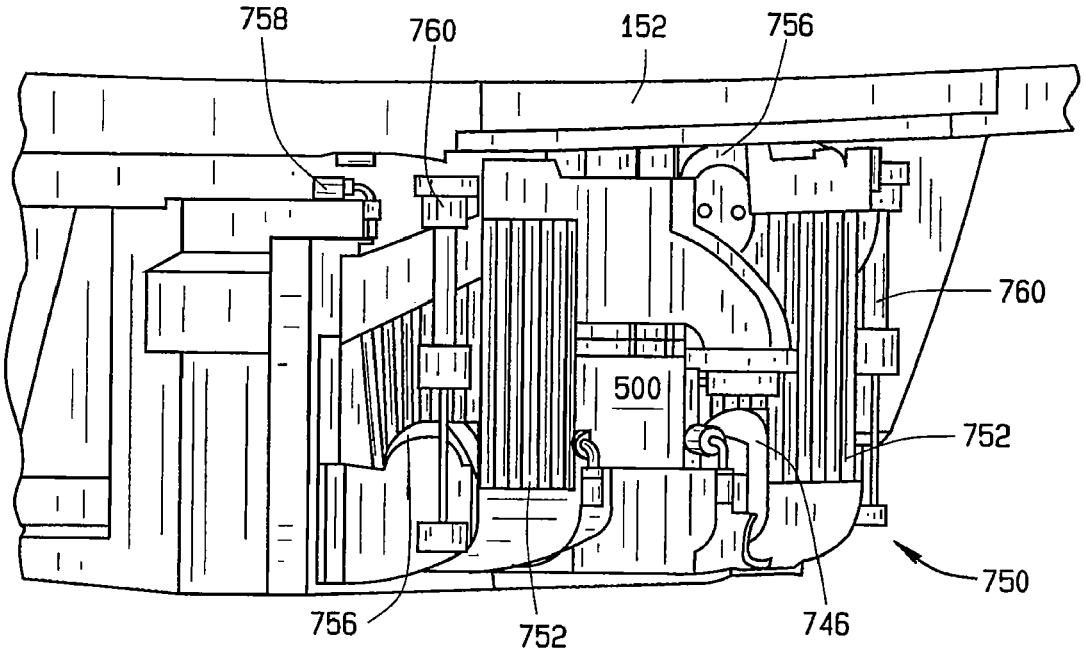
FIG. 17 is a perspective view of a hose retraction assembly.
Figure 18:
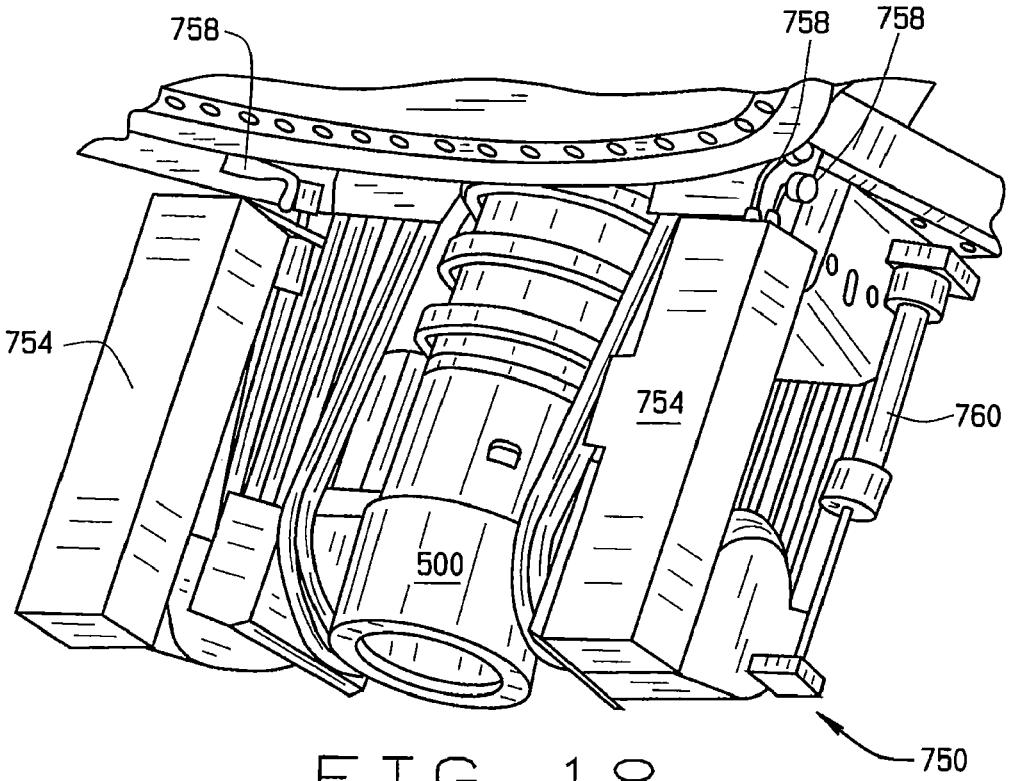
FIG. 18 is another perspective view of the hose retraction assembly.

FIGS. 17-18 illustrate perspective views of a hose retraction assembly 750, which stores surplus hose 752 for connecting hydraulic fluid and cooling water supply lines between the rotary union 160 and the shot sleeve assembly 500. At each station, the retraction assembly 750 attaches to the underside of the base 152 with frame members 754. In this way, four separate retraction assemblies 750 travel around the indexing assembly 100, each with a corresponding die block assembly 200. A pair of pulleys 756 mount vertically to each frame member 754 along each side of the shot sleeve assembly 500. The hose 752 wraps around each pair of pulleys 756 with one end of the hose 752 connected to the inlet ports 527 and 533 or waterlines 511 and the other end of the hose 752 connected to the rotary union 160 using standard connectors 758 well known in the art. The pulleys 756 of the assembly 750 between an extended position with the pulleys 756 generally adjacent to each other to a retracted position with the pulleys 756 at a designated distance from each other. In the extended position, the assembly 750 stores surplus hose 752 along the pulleys 756. In the retracted position, the assembly releases surplus hose 752 from the pulleys.

Figure 9:
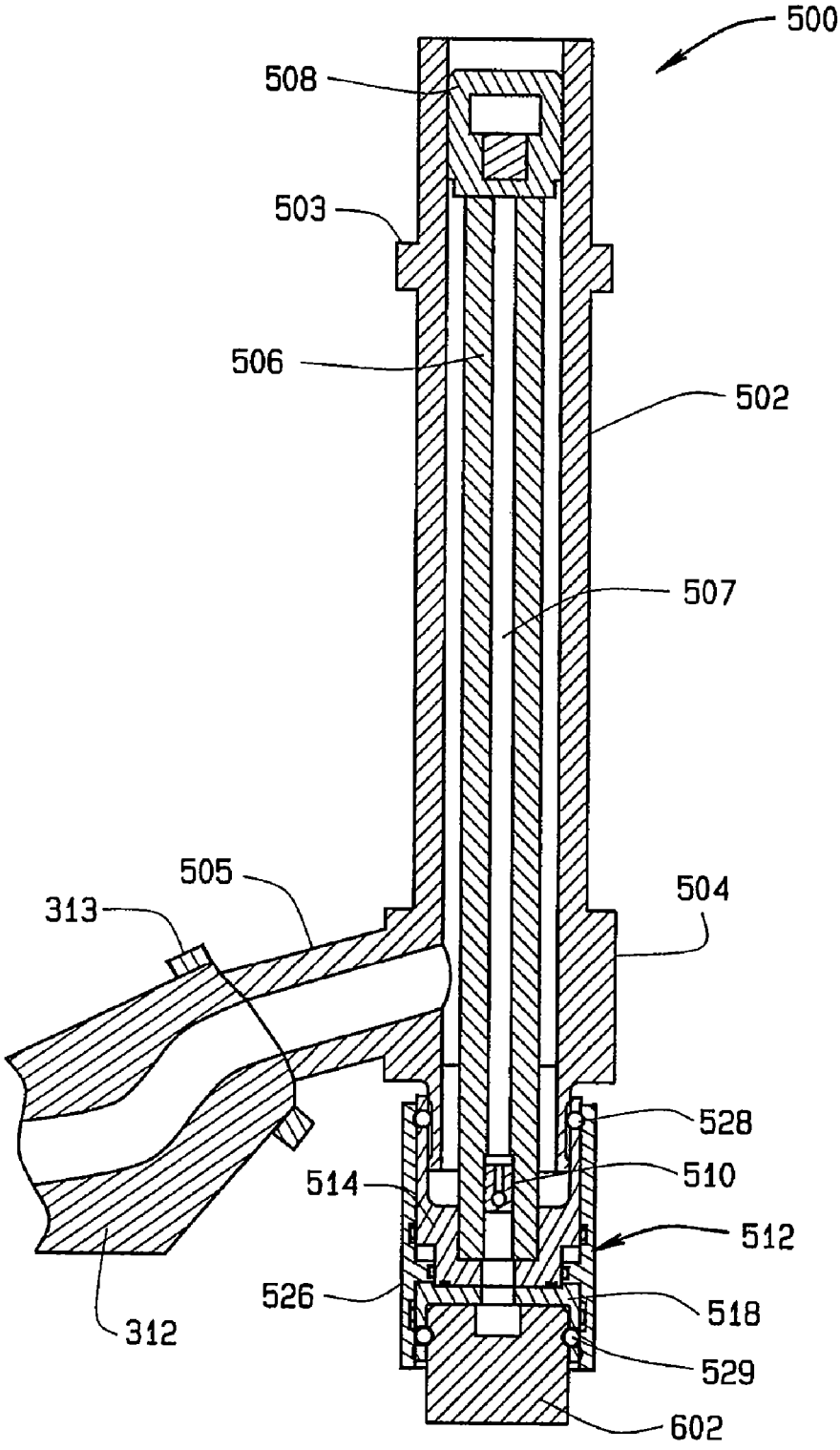
FIG. 9 is a section view along line A-A in FIG. 1 of a shot sleeve assembly in a extended position.

In operation, the retraction assembly 750 moves between the extended position and the retracted position corresponding to the shot sleeve assembly 500 as it extends and retracts as shown in FIGS. 9-10. As the shot sleeve assembly 500 retracts (FIG. 10), the retraction assembly 750 retracts, which releases hose from the pulleys 756. As the shot sleeve assembly 500 extends (FIG. 9), the retraction assembly 750 extends to take-up the hose 752. Cylinders 760 are attached between frame members 754 to provide stability as the assembly 750 extends and retracts.

Figure 19:
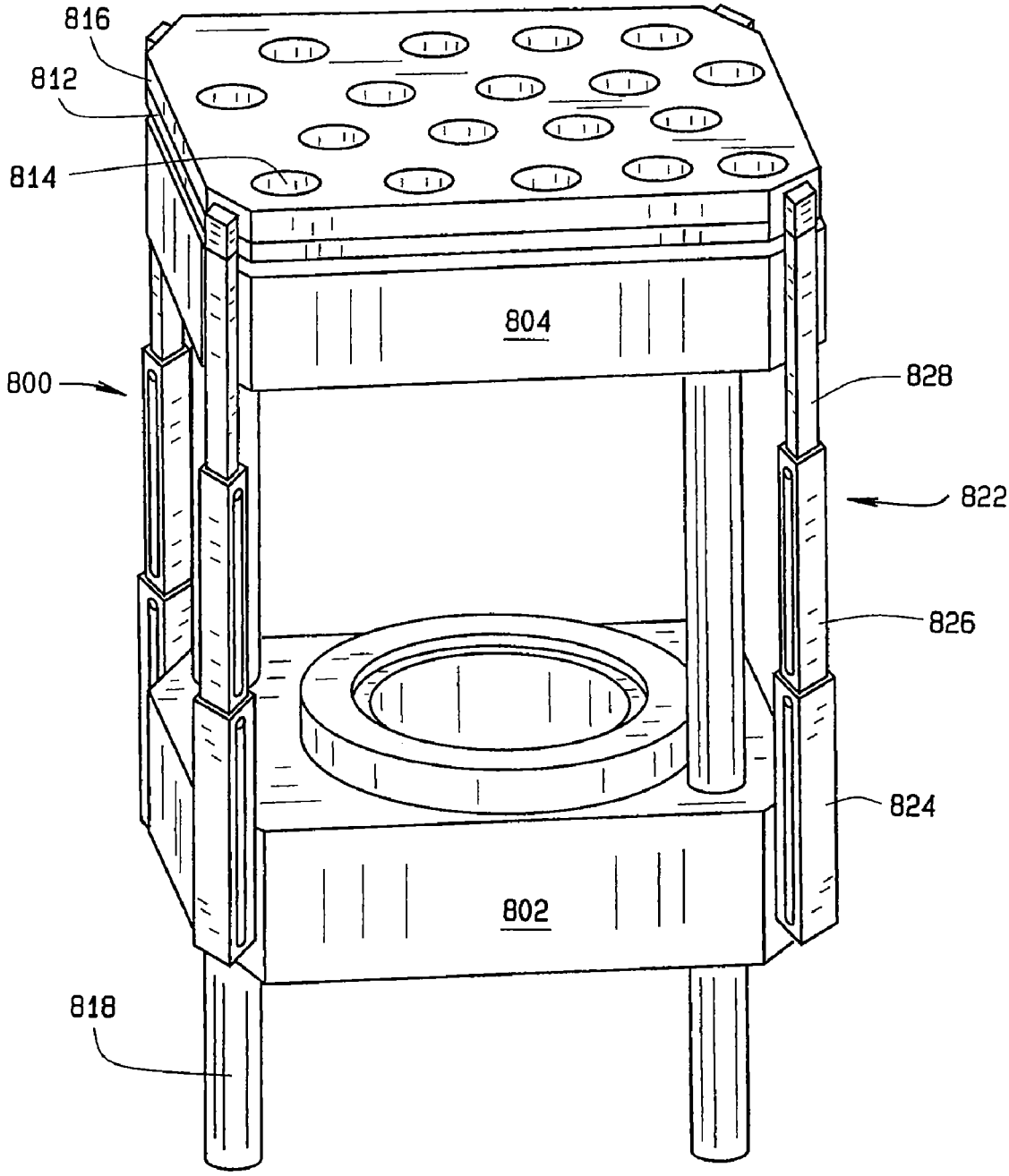
FIG. 19 is a perspective view of an alternate embodiment of a die block assembly in an extended position.
Figure 20:
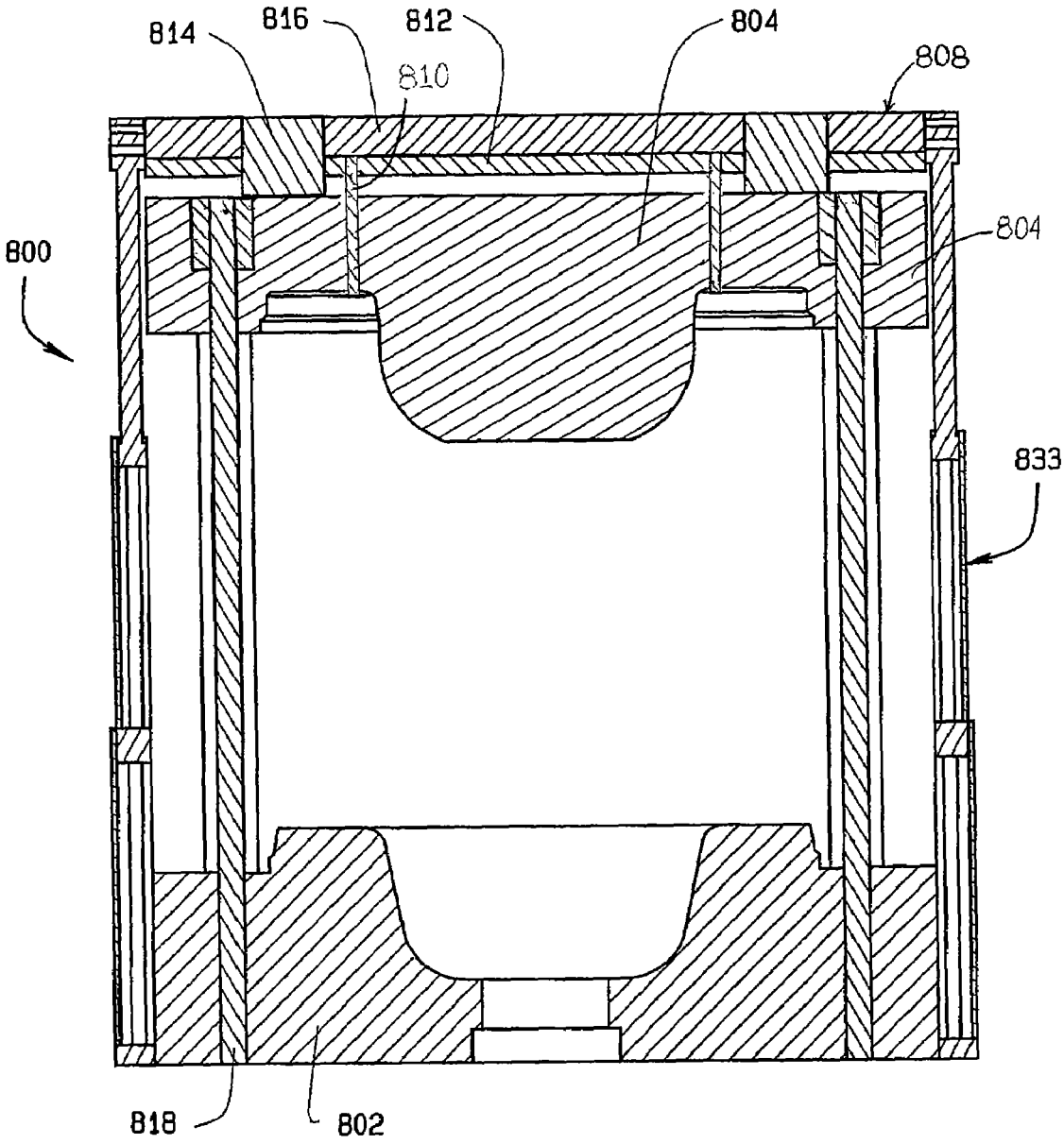
FIG. 20 is a section view of the alternate embodiment of the die block assembly in the extended position.
Figure 21:
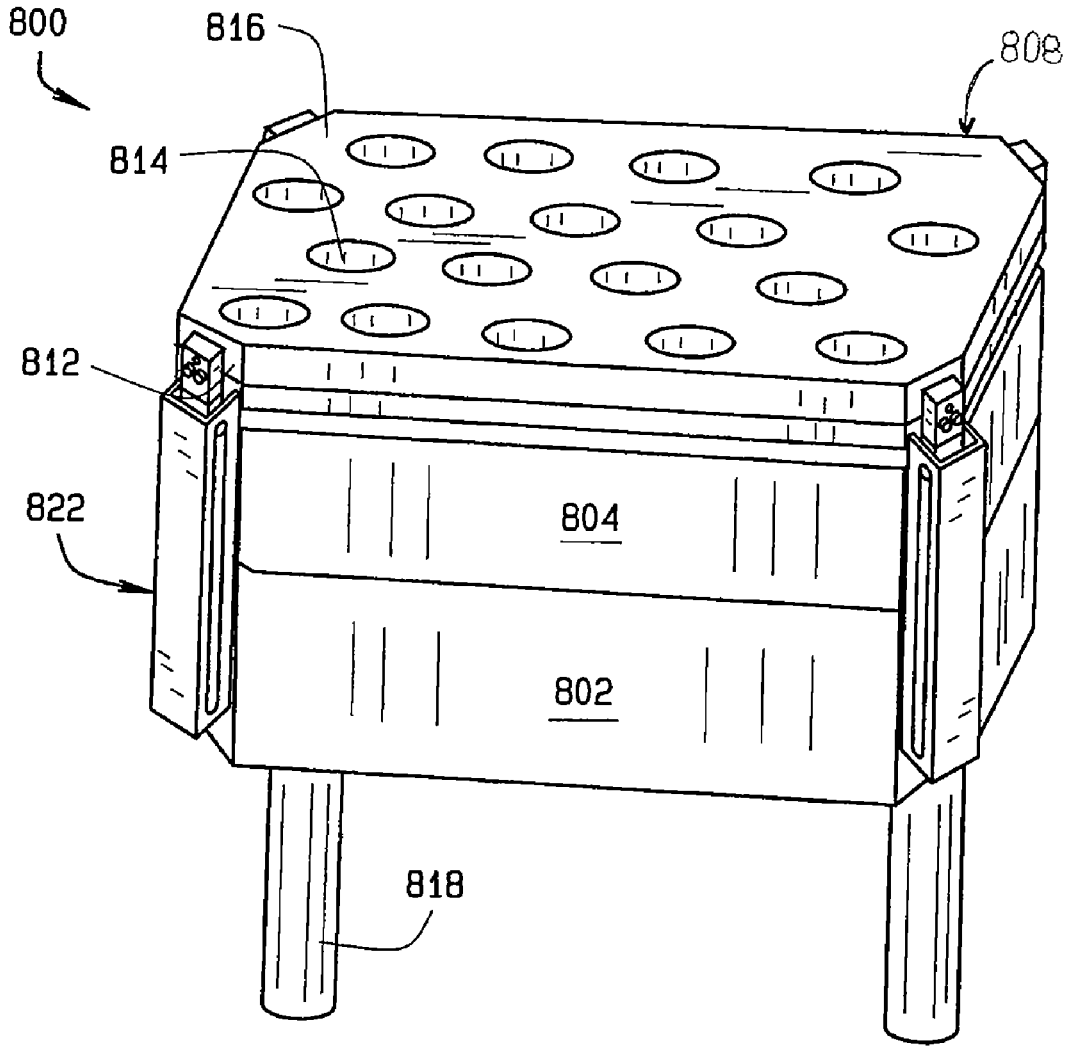
FIG. 21 is a perspective view of the alternate embodiment of the die block assembly in a closed position.

Illustrated in FIGS. 19-21, the alternate die block assembly 800 is similar to the die block assembly 200 comprising a generally rectangular block that includes a bottom half 802 and an ejector half 804 (the upper half of the die), which mate together to form a cavity 806. The bottom half 804 defines a counterbore 803 for receiving the shot sleeve assembly 500. Lock pins 818 extend downwardly from the ejector half 804 through bushings in the bottom half 802. During operation, the lock pins 818 can be raised or lowered to separate or mate the ejector half 804 with the bottom half 802. An ejector assembly 808 attaches to the top face of the ejector half 204 for ejecting finished parts from the die block 800. The ejector assembly 808 comprises a retainer plate 812 and a clamp plate 816. The retainer plate 812 is a rectangular plate with ejector pins 810 extending downwardly. The clamp plate 816 is a rectangular plate with the support pillars 814 extending downwardly from a bottom face and slidably attaches to the ejector half 804.

An extension assembly 822 is attached at each corner of the die block assembly 800 between the bottom half 802 and the clamp plate 816. Each extension assembly 822 comprises three nested extension members 824, 826, and 828, which slidably connect with slots 830 and pins 832 and move between an extended position and a retracted position.

In operation, the lift cylinders 702 of the lift assembly 700 extend, thereby, engaging the lock pins 818. The lift cylinders 702 continue to extend raising the lock pins 818, ejector half 804, and ejector assembly 808 until the extension assembly 822 completely extends and the ejector half 804 meets the ejector assembly 808. In this position, the ejector pins 810 protrude through the bottom face of the ejector half 204 to eject finished parts. When ejected, the finished part is grabbed and removed by a robotic arm (not shown) or other appropriate means. Afterwards, lift cylinders 702 retract, thereby returning the extension assembly 822 and die block assembly 800 to the closed position as shown in FIG. 21.

It should be noted that the extension assembly 822 eliminates the need for the knockout beam 230, lift assembly 700, and other associated parts at station 3 as shown in FIGS. 12-13B. Therefore in this embodiment, station 3 is identical to station 2. In this way, station 3 is capable of acting as an additional cooling station that allows additional cooling time. Thus, the die casting apparatus 10 allows for longer cooling times for parts having thicker walls.

Figure 22:
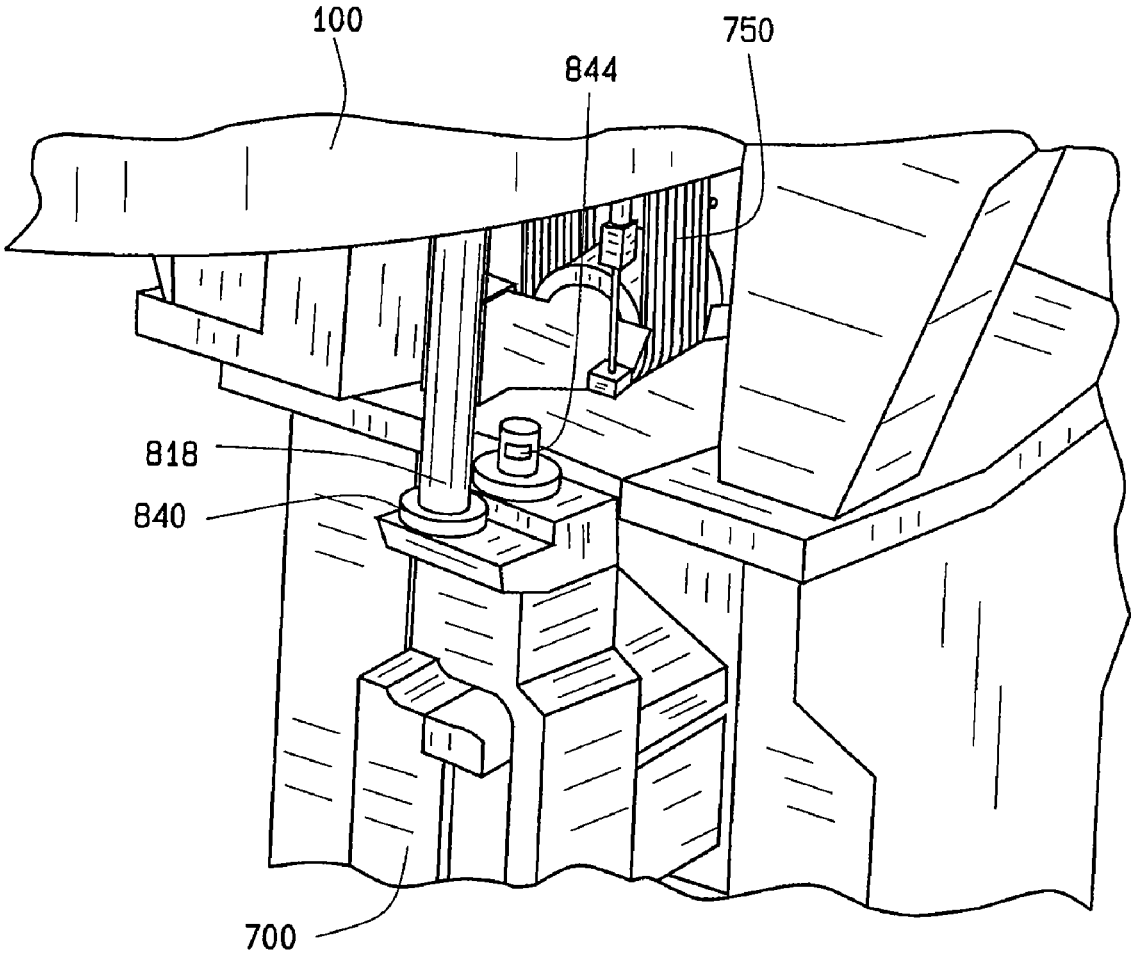
FIG. 22 is a perspective view of a securing assembly engaged with a locking pin.
Figure 23:
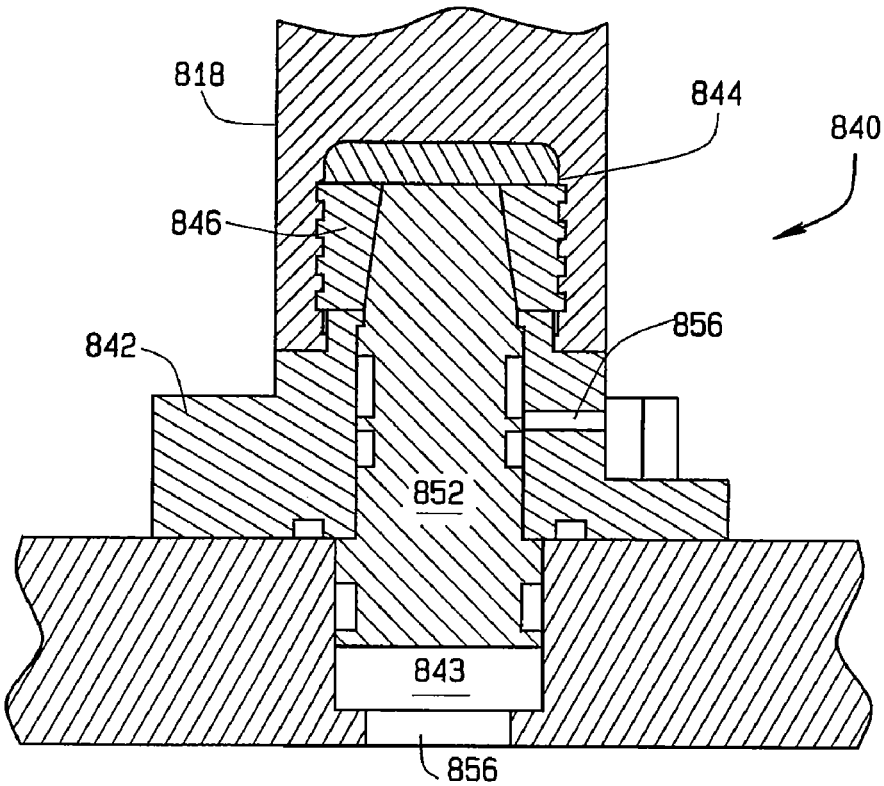
FIG. 23 is a section view of a securing assembly in an engagement position.
Figure 24:
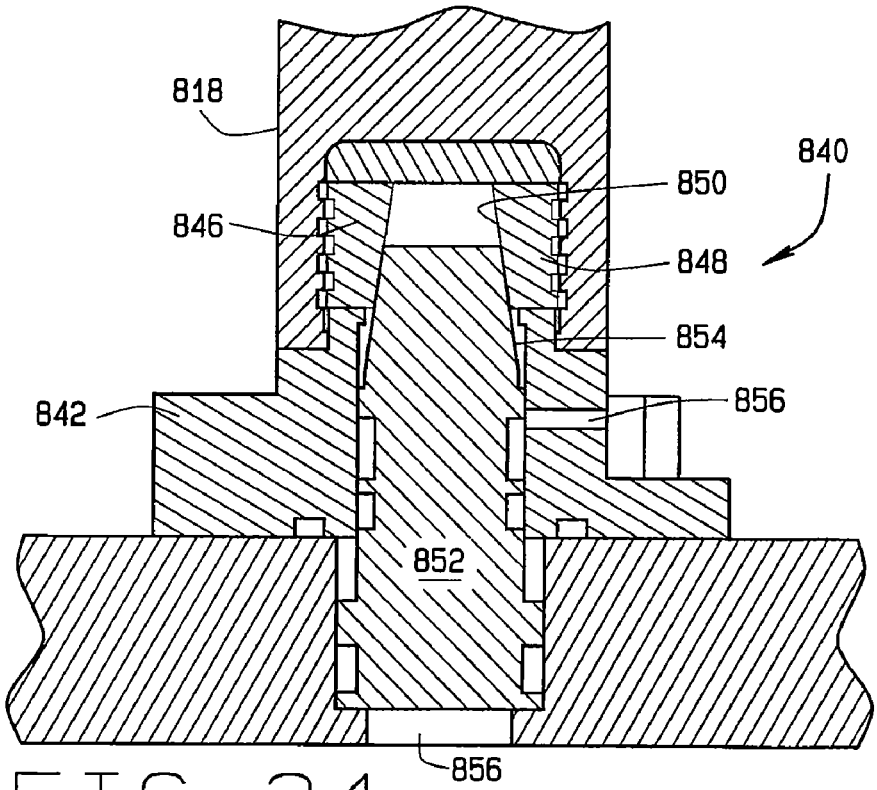
FIG. 24 is a section view of the securing assembly in a release position.

As shown in FIGS. 22-24, the drop assembly 720 can also have securing assemblies 840 that engage the locking pins 818 at station 4. Each securing assembly 840 comprises a cylindrical outer member 842 attached to the lift beam 706 at station 4. The outer member 842 is sized to fit within an inner diameter of the locking pins 218 or 818. The outer member 842 defines openings 844 that receive inner members 846. The inner members 846 have a grooved outer surface 848 for engaging the inner diameter of the locking pins 218 or 818 and a tapered inner surface 850. The outer member 842 defines a core 843 that receives a shuttle 852 having a tapered upper surface 854 that engages the tapered inner surface 850 of the inner member 846. The shuttle 852 moves between an engagement position (FIG. 23) and a release position (FIG. 24) using hydraulic power via hydraulic lines 856. In the engagement position, the shuttle 852 moves to the top of the core 843 which forces the inner member 850 outwardly partway through the openings 844 so that the grooved outer surface 848 engages the inner diameter of the locking pins 218 or 818. In the release position, the shuttle 852 moves to the bottom of the core 843 which allows the inner member 850 to move inwardly through the openings 844 and disengage from the inner diameter of the locking pins 218 or 818. The securing assemblies 840 create downward force on the die block assembly 200 or 800. This downward force may be needed for some operations, such as side-actions (not shown) within the die-block assembly 200 or 800.

Figure 25:
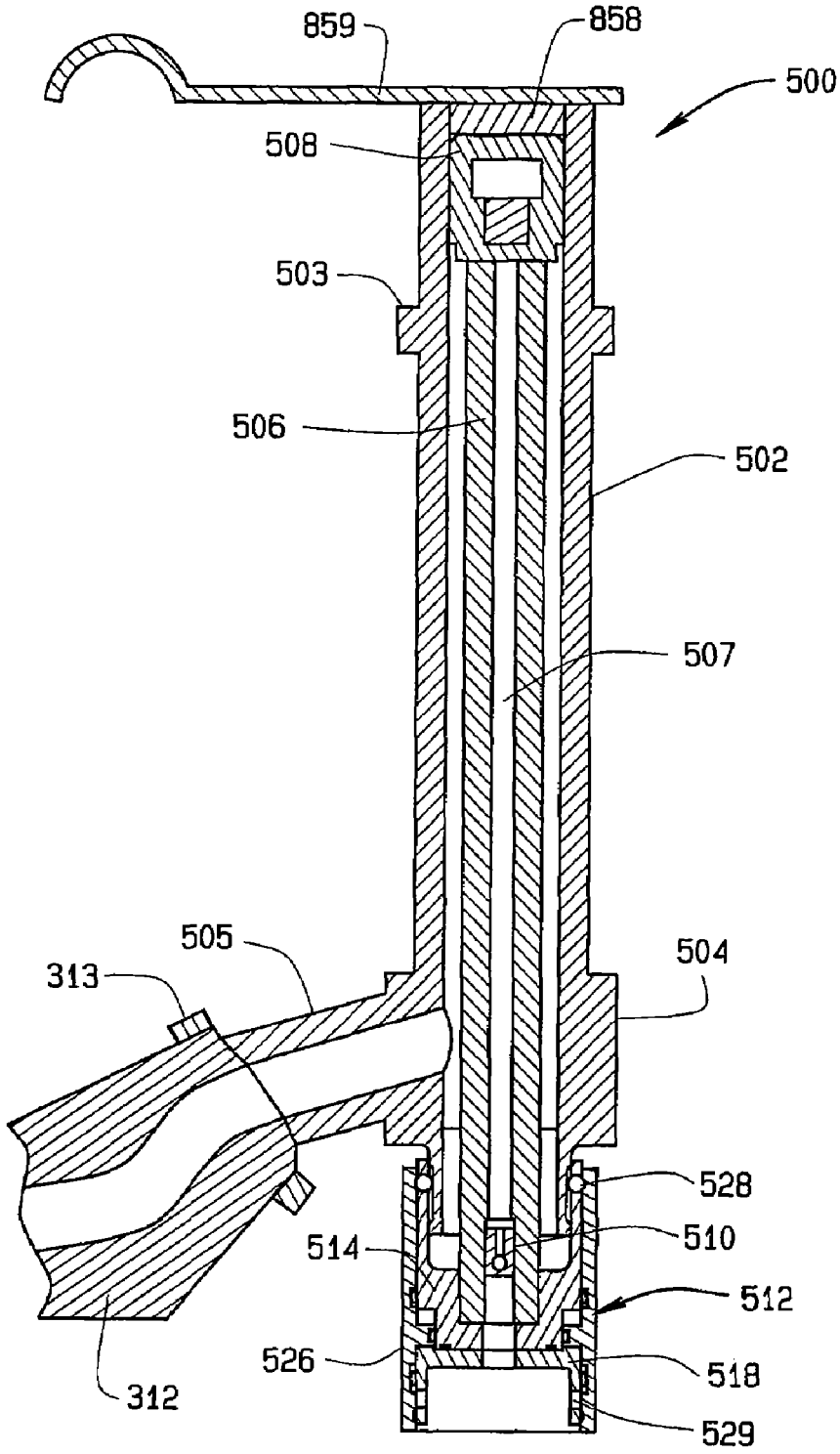
FIG. 25 is a section view along line A-A in FIG. 1 of a shot sleeve assembly in a extended position with a biscuit and flash runner.
Figure 26:
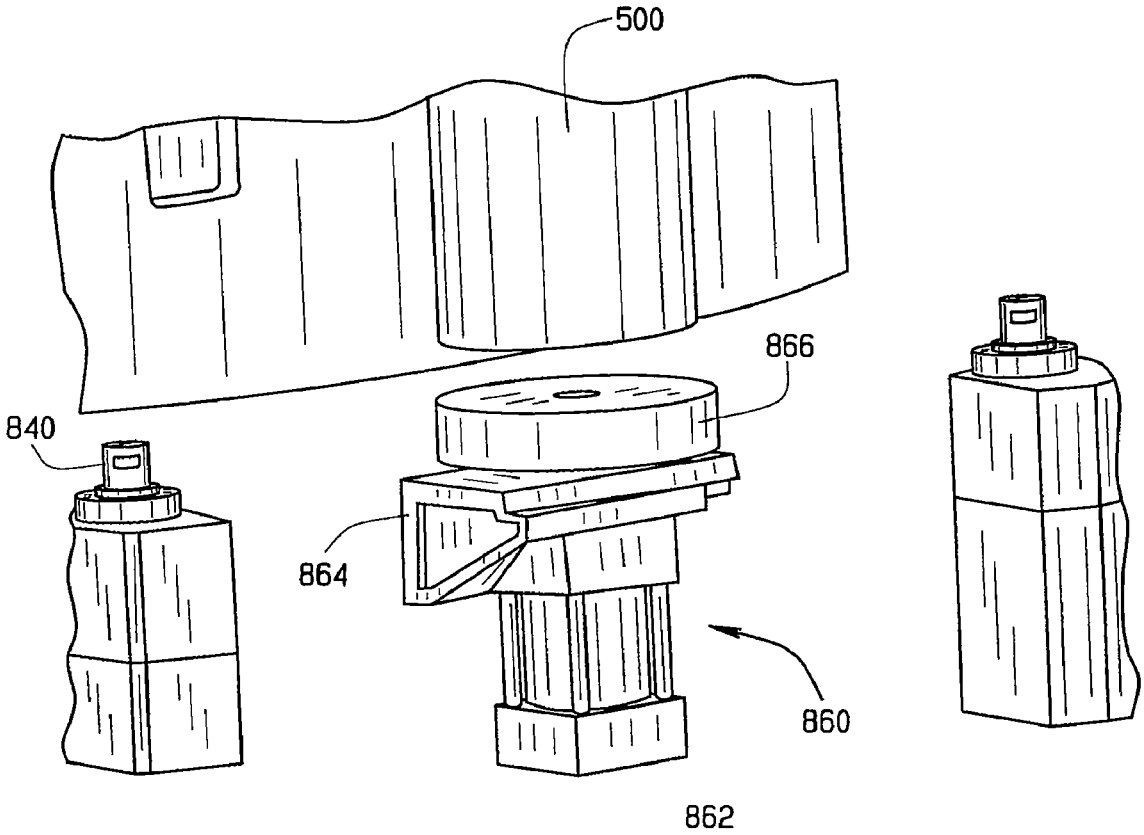
FIG. 26 is a perspective view of the biscuit ejection assembly.

During cooling, a biscuit 858 and runner flash 859 forms at the top of the shot sleeve assembly 400 as shown in FIG. 25. Therefore, a biscuit ejection assembly 860 as shown in FIG. 26 can be installed at stations 2 and/or station 3 to eject the biscuit 858 and flash 859. The ejection assembly 860 includes a piston 862 mounted to the leg 148 or 149 with a bracket 864 and an engagement member 866 attached to the piston 862 In operation, the piston 862 extends upward so that the engagement member 866 engages the shot sleeve assembly 400 and pushes the shot rod 506 to the top of the shot sleeve, thereby ejecting the biscuit 858 and runner flash 859 Afterwards, the piston 862 retracts and disengages from the shot sleeve assembly 400.

Changes can be made in the above constructions without departing from the scope of the invention, it is intended that all matter contained in the above description or shown in the accompanying drawings shall be interpreted as illustrative and not in a limiting sense. As will be appreciated by those skilled in the art, while the preferred embodiment of the invention finds application with respect to a die cast operation, other part construction operations are compatible with the broader aspects of the invention.

The invention claimed is:

1. A clamp assembly for a die casting apparatus, comprising:

a connector having teeth;

a moving platen including a bearing operatively engaged with the connector;

at least one toggle assembly operatively connecting the moving platen and the connector;

an upper platen; and an actuation cylinder attached to the upper platen, the actuation cylinder including a piston attached to the connector whereby the piston extends and retracts the clamp assembly between a clamp position and a release position.

2. The clamp assembly of claim 1, wherein the toggle assembly comprises:

an upper pressure block attached to the upper platen;

a lower pressure block assembly attached to the moving platen;

toggles pivotally attached to the upper pressure block and lower pressure block assembly with toggle links;

a central toggle pivotally interposed between the toggles with toggle links and pivotally engaged with the connector whereby the toggle assembly moves between a clamp position to a release position.

3. The clamp assembly of claim 2, wherein the lower pressure block assembly comprises:

an upper block;

a lower block operatively connected to the upper block with guides;

a lead screw block attached to the moving platen and juxtaposed with the upper block and lower block;

a lead screw threaded through the lower block and lead screw block, wherein the lead screw is adjusted to increase and decrease the compression load of the toggle assembly in the clamp position.

4. The clamp assembly of claim 2, the clamp position being an arrangement with the toggles in generally vertical alignment and the central toggle generally perpendicular to the toggles.

5. The clamp assembly of claim 1, wherein the lower block comprises a tapered upper surface having a dovetail guide that engages with a tapered lower surface of the upper block having a corresponding dovetail guide.

6. The clamp assembly of claim 1, wherein the connector comprises a generally upright rod with the teeth extending generally outwardly from a top end to engage at least one toggle assembly.

7. The clamp assembly of claim 1, wherein the die casting apparatus comprises:

at least one block assembly;

an indexing assembly removably engaged with at least one block assembly for indexing between stations;

an injection station including a frame, the clamp assembly attached to the frame for clamping and releasing at least one block assembly, a shot sleeve assembly engaged with at least one block assembly for receiving material from at least one source and injecting the material into the block assembly, a shot cylinder removably coupled with the shot sleeve assembly for controlling the injection of material;

an ejection station including an ejector lift assembly which engages at least one block assembly for ejecting a finished part from the block assembly;

a recovery station including an ejector drop assembly which engages at least one block assembly for placing a preload on the die block assembly; and a control panel operatively connected to the indexing assembly, the injection station, the ejection station, and the recovery station to control the operation and timing of the apparatus.

8. A clamp assembly for a die casting apparatus, comprising:

a connector having teeth;

a moving platen including a bearing operatively engaged with the connector;

a means for connecting the moving platen and the connector;

an upper platen; and an actuation cylinder attached to the upper platen, the actuation cylinder including a piston attached to the connector and extending downward whereby the piston extends and retracts the clamp assembly between a clamp position and a release position.

9. The clamp assembly of claim 8, wherein the means for connecting comprises:

an upper pressure block attached to the upper platen;

a lower pressure block assembly attached to the moving platen;

toggles pivotally attached to the upper pressure block and lower pressure block assembly with toggle links;

a central toggle pivotally interposed between the toggles with toggle links and pivotally engaged with the connector whereby the means for connecting moves between a clamp position to a release position.

10. The clamp assembly of claim 9, wherein the lower pressure block assembly comprises:

an upper block;

a lower block operatively connected to the upper block with guides;

a lead screw block attached to the moving platen and juxtaposed with the upper block and lower block;

a lead screw threaded through the lower block and lead screw block, wherein the lead screw is adjusted to increase and decrease the compression load of the toggle assembly in the clamp position.

11. The clamp assembly of claim 9, the clamp position being an arrangement with the toggles in generally vertical alignment and the central toggle generally perpendicular to the toggles.

12. The clamp assembly of claim 8, wherein the lower block comprises a tapered upper surface having a dovetail guide that engages with a tapered lower surface of the upper block having a corresponding dovetail guide.

13. The clamp assembly of claim 8, wherein the connector comprises a generally upright rod with the teeth extending generally outwardly from a top end to engage at least one toggle assembly.

14. The clamp assembly of claim 8, wherein the die casting apparatus comprises:

at least one block assembly;

an means for indexing removably engaged with at least one block assembly for indexing between stations;

an injection station including a frame, the clamp assembly attached to the frame for clamping and releasing at least one block assembly, a means for receiving material from at least one source and injecting the material into at least one block assembly, a means for controlling the injection of material into the means for receiving;

an ejection station including a means for ejecting a finished part from the block assembly;

a recovery station including a means for placing a preload on the die block assembly; and a means for controlling the operation and timing of the apparatus operatively connected to the means for indexing, the injection station, the ejection station, and the recovery station.

15. A clamp assembly, comprising:

a connector having teeth extending outwardly from an upper end;

a moving platen including a bearing moveably engaged with the connector;

an upper platen;

at least one toggle assembly moveably connecting to the upper platen, the moving platen, and the teeth of the connector; and an actuation cylinder attached to the upper platen, the actuation cylinder including a piston attached to the connector whereby the piston extends and retracts the clamp assembly between a clamp position for applying compressive force and a release position.

16. The clamp assembly of claim 15, wherein the toggle assembly comprises:

an upper pressure block attached to the upper platen;

a lower pressure block assembly attached to the moving platen;

toggles pivotally attached to the upper pressure block and lower pressure block assembly with toggle links;

a central toggle pivotally interposed between the toggles with toggle links and pivotally engaged with the connector whereby the toggle assembly moves between a clamp position to a release position.

17. The clamp assembly of claim 16, the clamp position being an arrangement with the toggles in generally vertical alignment and the central toggle generally perpendicular to the toggles.

18. The clamp assembly of claim 15, wherein the lower pressure block assembly comprises:

an upper block;

a lower block operatively connected to the upper block with guides;

a lead screw block attached to the moving platen and juxtaposed with the upper block and lower block;

a lead screw threaded through the lower block and lead screw block, wherein the lead screw is adjusted to increase and decrease the compression load of the toggle assembly in the clamp position.

19. The clamp assembly of claim 15, wherein the lower block comprises a tapered upper surface having a dovetail guide that engages with a tapered lower surface of the upper block having a corresponding dovetail guide.

20. The clamp assembly of claim 15, wherein the connector comprises a generally upright rod with the teeth extending generally outwardly from a top end to engage at least one toggle assembly.

21. The clamp assembly of claim 15, wherein the die casting apparatus comprises:

at least one block assembly;

an indexing assembly removably engaged with at least one block assembly for indexing between stations;

an injection station including a frame, the clamp assembly attached to the frame for clamping and releasing at least one block assembly, a shot sleeve assembly engaged with at least one block assembly for receiving material from at least one source and injecting the material into the block assembly, a shot cylinder removably coupled with the shot sleeve assembly for controlling the injection of material;

an ejection station including an ejector lift assembly which engages at least one block assembly for ejecting a finished part from the block assembly;

a recovery station including an ejector drop assembly which engages at least one block assembly for placing a preload on the die block assembly; and a control panel operatively connected to the indexing assembly, the injection station, the ejection station, and the recovery station to control the operation and timing of the apparatus.

* * * * *